US005832998A

United States Patent [19]

Decker et al.

[11] Patent Number: 5,832,998

[45] Date of Patent: Nov. 10, 1998

[54] COILED TUBING DEPLOYED INFLATABLE STIMULATION TOOL

[75] Inventors: Kenneth L. Decker; John H. Yonker, both of Carrollton, Tex.; Wallace G. Wilke, Jr., New Iberia, La.; Jeffrey S. Walter, Duncan, Okla.; James C. Tucker, Duncan, Okla.; Kenneth W. McIntyre, Duncan, Okla.; Michael L. Connell, Duncan, Okla.; Kenneth D. Caskey, Duncan, Okla.

[73] Assignee: Halliburton Company, Dallas, Tex.

[21] Appl. No.: 433,787

[22] Filed: May 3, 1995

[51] Int. Cl.[6] ..... E21B 33/127

[52] U.S. Cl. ..... 166/185; 166/187

[58] Field of Search ..... 166/387, 181, 166/185, 186, 187, 77.2

[56] References Cited

U.S. PATENT DOCUMENTS

| | | | |
|---|---|---|---|
| 4,424,860 | 1/1984 | McGill | 166/187 |
| 4,458,752 | 7/1984 | Brandell | 166/187 |
| 5,271,461 | 12/1993 | Decker et al. | 166/185 |

*Primary Examiner*—William P Neuder

[57] ABSTRACT

A resettable well stimulation tool is lowerable into a well bore on a length of tubing through which pressurized fluid may be forced into the tool to inflate a packer portion carried by the tool and then discharge a stimulation fluid into a portion of the well bore sealed off by the packer portion. During the inflation cycle of the tool pressurized fluid is forced downwardly into an annular tool body inflation chamber that communicates with an inflatable packer carried by the tool body. A perforated tube member coaxially carried in the inflation chamber serves to vertically distribute the inflation pressure along the length of the packer and assure its even inflation. In a straddle packer embodiment of the tool inflation and stimulation passages extend internally through the tool and are sealingly separated by an internal crossover structure, with the inflation passage being in communication with upper and lower packer members. The internal inflation passage eliminates the previous necessity of communicating the upper and lower packers with inflation tubing externally coiled around the tool body. A longitudinally intermediate portion of the tool body has a telescoping expansion joint portion to compensate for the longitudinal forces exerted on the body by inflation of the packers. The expansion joint is biased, by both mechanical spring pressure and internal fluid pressure, toward a retracted position thereof.

32 Claims, 15 Drawing Sheets

COILED TUBING DEPLOYED INFLATABLE STIMULATION TOOL

CROSS-REFERENCE TO RELATED APPLICATION

This application discloses subject matter similar to that disclosed in U.S. application Ser. No. 07/882,308 filed on May 13, 1992 entitled "Coiled Tubing Deployed Inflatable Stimulation Tool", now U.S. Pat. No. 5,271,461.

BACKGROUND OF THE INVENTION

This invention relates generally to inflatable packers used in well bores, and in particular to inflatable packers which may be deployed on coiled tubing and used for introducing stimulation fluids into one area of the well bore while isolating other areas of the well bore.

Inflatable downhole tools are well known in the art and are used to perform a variety of tasks associated with completing and operating earth wells of various types, including oil, gas, water and environmental sampling and disposal wells.

Also, in the course of operating oil and gas wells, such wells may fail to sustain the same level of production as when they were first drilled because the face of the producing formation where it intersects the well bore has become fouled with debris or has become coated with a layer of insoluble mineral salts. When this occurs, it becomes necessary to rework the wells by placing stimulation fluids into the well bore to renew the face of the producing formation by dissolving the debris or mineral salts. When such stimulation work is performed, it is frequently desirable to isolate one producing zone from another and from other areas of the well bore to prevent the stimulation fluids from coming in contact with such other zones and such other areas of the well bore.

In order to introduce stimulation fluids into one area of a well bore while isolating other areas, a well bore packer must be employed as a part of the work string to accomplish such isolation. Also, since there are quite often several zones to be stimulated, it is desirable to be able to move the stimulation tool string up or down the well bore and to be able to unset, move and reset the packer several times to accomplish the stimulation work more efficiently.

In recent years it has become more economical to utilize coiled tubing to perform such stimulation jobs than to erect a workover rig and use other forms of conduits, such as jointed pipe, to perform the same function.

Inflatable packers which are designed to be set in open or uncased earth wells which often have irregular side walls, such as petroleum producing wells, or water wells, have been found desirable for many years. As a result, packers in which the sealing elements are designed to be hydraulically inflatable, and inflatable packers where the inflated sealing elements are designed to withstand high hydraulic pressures have become well known in the art. Also, inflatable tools which combine an inflatable sealing element with a device to either take in samples from a well bore or discharge stimulation fluids, such as acids, to a well bore are also known in the art. Additionally, it has become well known that inflatable packer elements tend to remain somewhat distended after deflation, often making retrieval of the packer difficult. To combat this undesirable tendency, prior art devices have had features added to aid in restoring the element to its original shape.

The chief limitations of these prior art devices which have become recognized and are sought to be overcome by this invention include unreliable sealing mechanisms which do not provide in all cases a positive seal between the tool string and the packer element to prevent undesired inflation or deflation of the packer element, and reliable means to restore the element, once deflated, to its original shape.

Another limitation is that many prior art devices have complex valve assemblies which are difficult to shift from one mode of operation to another. Also, when the tool is at a great depth in the well many prior art devices do not provide reliable signals to the operator at the surface that a shift in mode of operation has taken place within the tool.

Further limitations of these prior art designs which this invention seeks to overcome are: unreliable or difficult to operate valving mechanisms for shifting the tool between its various operations such as inflation and deflation of the element, equalization of the interior of the tool with the pressure of the well bore, shifting the tool to and from a fluid discharge, circulation, inflation, or stimulation mode; and the general unavailability of repetitive setting mechanisms which enable multiple setting and unsetting of an inflatable tool in a single trip.

In straddle packer tool embodiments another limitation presented is the use of inflation tubing coiled around the exterior of the tool body to communicate the upper and lower packers for simultaneous inflation. This externally coiled tubing very substantially limits the maximum length between packer elements and also presents problems in lowering and retrieving the tool into and out of the well. A further problem which may be encountered in the packer portions of these types of tools is the tendency of a packer member to become adhered to the tool body mandrel section around which the packer member extends, thereby potentially creating uneven or incomplete inflation of the packer or damage thereto. It is a further object of the present invention to address and substantially alleviate these problems associated with tools of the general type described above.

SUMMARY OF THE INVENTION

In carrying out principles of the present invention, in accordance with a preferred embodiment thereof, well packer apparatus is provided that comprises a tubular outer body structure having, along its length, an annular gap in which a tubular inflatable packer member is operatively supported. A tubular inner body structure is coaxially disposed within the outer body structure and defines therewith a generally annular packer inflation passage for receiving a pressurized fluid operative to inflate the packer member, an axial portion of the inflation passage being radially outwardly bounded by the packer member.

To facilitate the even and complete inflation of the packer member a perforated inflation pressure distribution tube member is provided. The distribution tube is coaxially disposed within the annular packer inflation passage and axially divides a portion thereof into a first subannulus disposed between the inner body structure and the pressure distribution tube member, and a second subannulus disposed between the pressure distribution tube member and the outer body structure. Representatively, the pressure distribution tube member is captively retained within the inflation passage for axial movement relative thereto.

According to another aspect of the present invention a well stimulation/straddle packer tool is provided and is lowerable into a well bore on conduit means through which a pressurized fluid may be supplied to the tool. The tool includes an elongated hollow tubular body having an open upper end to which a lower end of the conduit means may be connected, and an exterior side wall extending along the length of the body. Annular inflatable first and second packer structures are coaxially carried on upper and lower longitudinal portions of the exterior side wall, respectively, and a stimulation fluid discharge opening is formed in the exterior side wall between the first and second packer structures.

A first flow passage extends interiorly through the body, and is sealingly isolated from the stimulation fluid discharge opening and operatively communicated with the first and second packer structures. A second flow passage extends interiorly through the body, and is communicated with the stimulation fluid discharge opening and isolated from the first and second packer structures.

Fluid flow path control means are provided and are operable to route pressurized fluid received through the open upper end of the body through a selectively variable one of the first and second flow passages to thereby selectively inflate the first and second packer structures using the pressurized fluid or force the pressurized fluid outwardly through the stimulation fluid discharge opening. To sealingly isolate the first and second flow passage from one another within the interior of the tool a ported crossover structure is disposed within the tool body, with portions of each of the first and second flow passages extending through the crossover structure.

The use of the interior inflation fluid flow passage that intercommunicates the upper and lower packers advantageously eliminates the conventional necessity of interconnecting the upper and lower packers for simultaneous inflation by pressure transfer tubing coiled around the exterior of the tool body. Accordingly, the packer-to-packer distance may be made quite long while still permitting the elongated tool to be lubricated into the well. In a representatively illustrated embodiment of the tool the upper and lower longitudinal portions of the tool which respectively carry the upper and lower packers are interconnected with an elongated section of coiled tubing axially extending between the upper and lower longitudinal tool portions.

According to another aspect of the invention, to compensate for the axial forces exerted on a longitudinally intermediate portion of the tool body between the upper and lower packer members by the radially outward inflation extension of the packer members the longitudinally intermediate tool body portion has operatively interposed therein a telescopable expansion joint structure axially movable between retracted and extended positions. Optional spring means are carried by the tool body and exert a mechanical biasing force on the expansion joint structure to resiliently urge it toward its retracted position, which supplements the biasing force of the expansion joint structure's weight.

These mechanical and weight biasing forces are augmented during the initial inflation of the upper and lower packer members by fluid pressure force exerting means which, in response to the presence of pressurized fluid within the first flow passage, operate to exert a fluid pressure force on the expansion joint structure in a manner further biasing the expansion joint structure toward its retracted position.

BRIEF DESCRIPTION OF THE DRAWINGS

FIG. 8 is a sectional view of the upper portion of the stimulation tool with the velocity valve in its third, lowermost position and the outer mandrel inflation ports open (the inflation position);

FIG. 9 is a sectional view of the upper portion of the stimulation tool, with the velocity valve in its second position and the outer mandrel inflation ports sealed (the stimulation position);

DETAILED DESCRIPTION

Figures 1, 5:
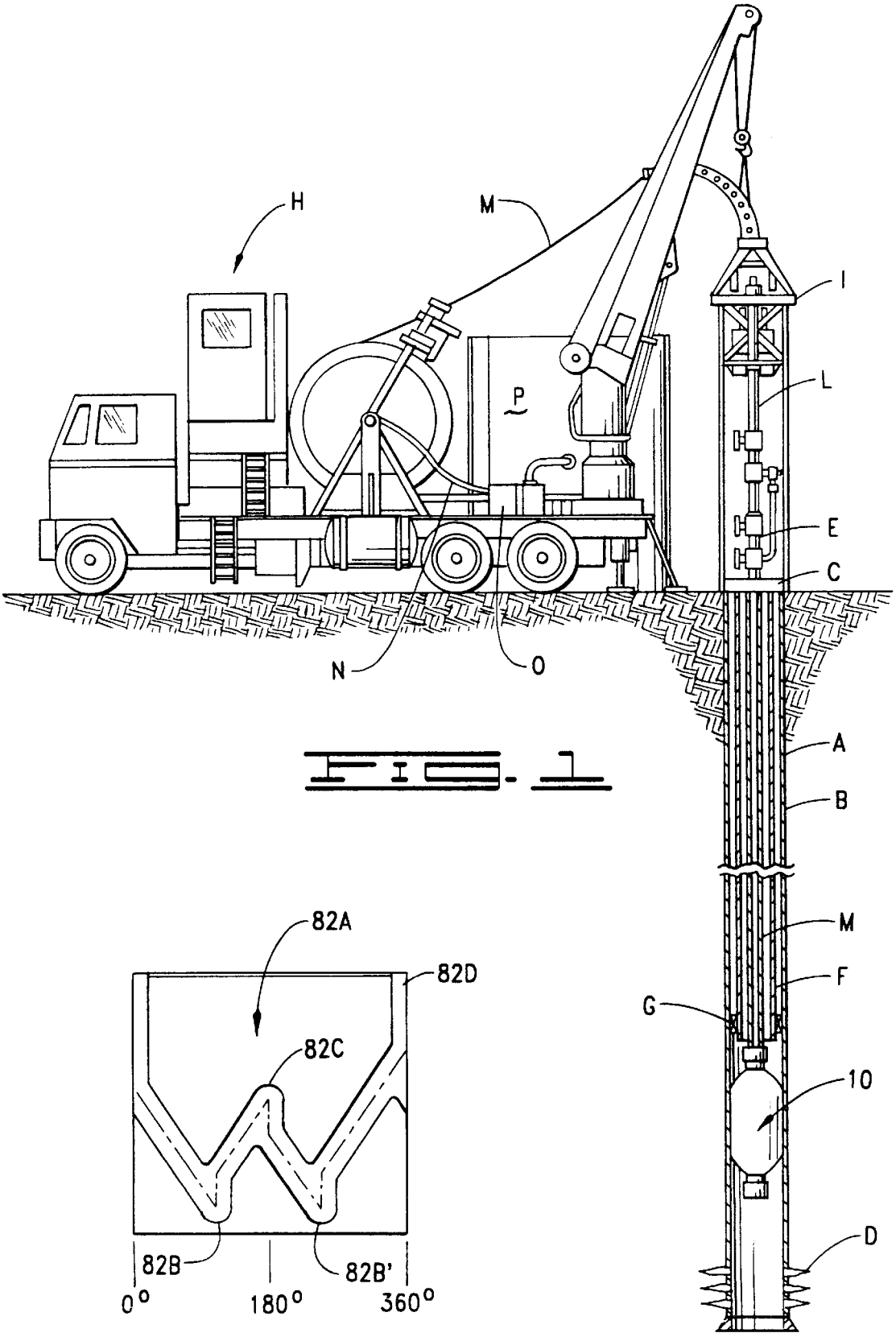
FIG. 1 is an elevational view, partially in section, of a coiled tubing truck, coiled tubing injector, well Christmas tree and well bore with the invention in its expanded, stimulation mode.
FIG. 5 is a developed view of the continuous J-slot on the velocity valve of the invention.

In the description which follows, like parts are indicated throughout the specification and drawings with the same reference numerals, respectively. The drawings are not necessarily to scale and the proportions of certain parts may have been exaggerated to better illustrate the details of the invention. It is to be understood and is intended that this invention pertains to all possible orientations of well bores including vertical, deviated, highly deviated and horizontal, although it is shown only with respect to the vertical.

Referring now to FIG. 1, when an earth well is completed, a length of casing A extends for some length into the earth from the well head C and is cemented in place. The casing A has perforations D along its length adjacent to producing formations which intersect well bore B, the well bore B being defined by the interior surface of the casing A.

A Christmas Tree E is mounted on the well head C, from which a length of production tubing F extends for some distance into the casing and may even extend beyond the end of the casing A into an open, or uncased portion of the earth. Packing devices G are usually set at some point within the casing A to seal the production tubing to the casing and function to channel fluids produced through perforations D to the surface through production tubing F.

Occasionally during the producing life of a well, the face of the producing formation adjacent the well bore or adjacent the perforations in the casing will become clogged with debris, such as fine sand or precipitated mineral salts, necessitating a well workover. To perform the well workover, a workover rig can be moved on to the well site to perform the workover. However, with the ready availability of more economical mobile coiled tubing units, use of such coiled tubing units is becoming the method of choice for performing well workovers. Such workovers are frequently called stimulation jobs.

As shown in FIG. 1, in order to perform the stimulation job using coiled tubing, a coiled tubing truck H is driven to the well site. A coiled tubing injector I and, if well conditions dictate, a lubricator L is rigged up on the well. A connection is made to the Christmas Tree E to allow a continuous length of coiled tubing M, to which the stimulation tool 10 is attached, to be fed into the production tubing F.

The coiled tubing M is connected by hose means N to a pump O and reservoir P which contains the stimulation fluids. Fluids such as acids and/or surfactants are usually selected to clean the obstructed face of the formation thereby both restoring the face to a permeability level approximating its original permeability and restoring the well's production to a level approximating production levels when the well was first brought on production.

Within the coiled tubing truck H are instruments such as pressure monitors and flow rate indicators, not shown, comprising either digital or analog gauges connected to sensors, also not shown, to indicate the pressure and rate of flow of the stimulation fluids through the coiled tubing M.

Figure 2:
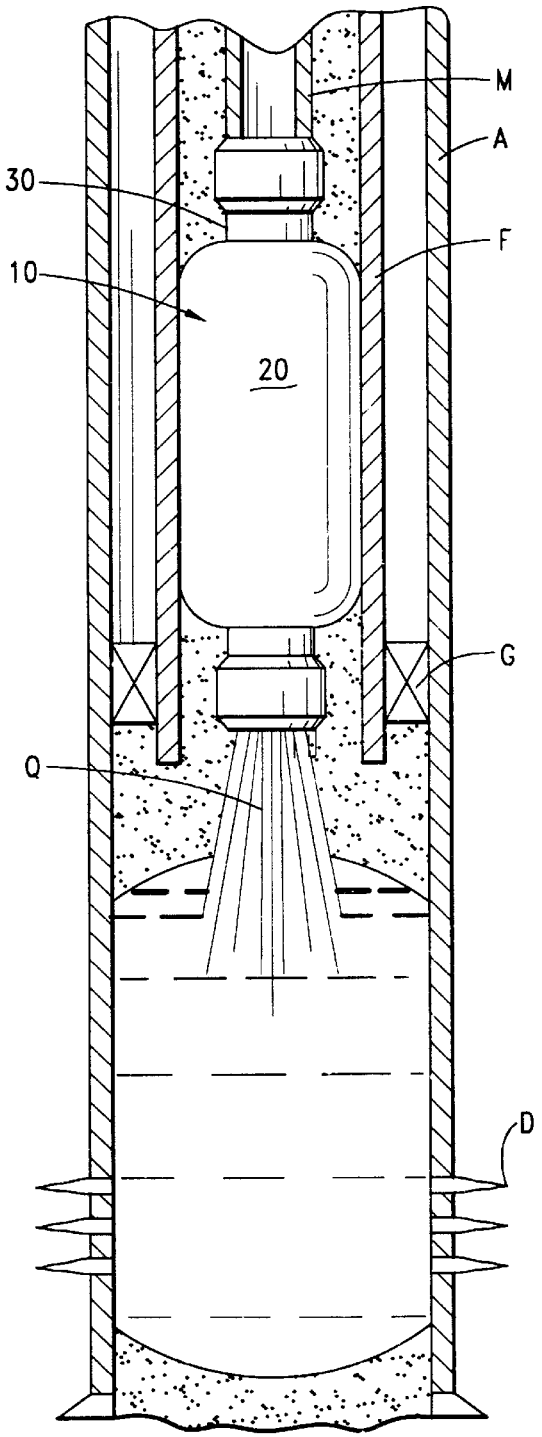
FIG. 2 is an enlarged scale view of the inflatable stimulation tool located and expanded in a cross section of a well bore with the tool discharging fluids as in the stimulation mode.

As shown in FIG. 2, the stimulation tool 10 includes an inner mandrel 30 with a flow path therethrough which is attached to coiled tubing M and has inflatable packer element 20 sealingly disposed thereon. Once inflatable packer element 20 is inflated into cooperative sealing engagement with the casing A or the production tubing F, as shown in FIG. 2, stimulation fluids Q are discharged through the flow path in the tool into contact with the face of the producing formation.

It is to be understood that stimulation tool 10, although hereinbelow described as being run in casing A or production tubing F, may also be run in the well bore B before casing A has been set. In that instance, instead of the packer element 20 contacting the interior surface of casing A or production tubing F, it would contact the interior surface of the earth well. And, instead of fluids Q being pumped into the formation through perforations D, the fluids Q would be pumped directly into the formation.

Figure 4A:
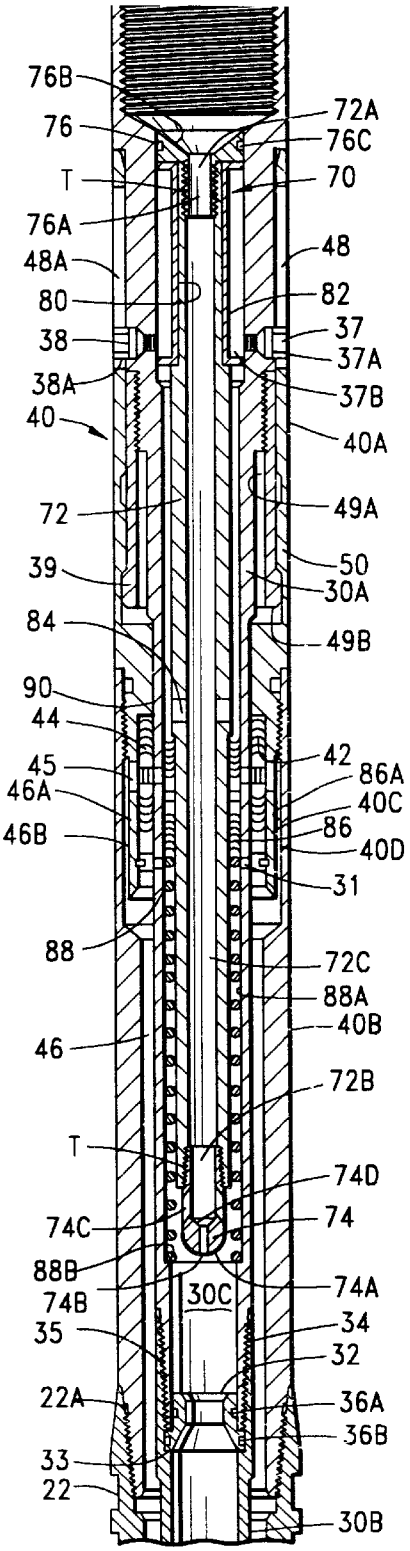
FIGS. 4A through 4C are sectional views of the stimulation tool.
Figure 4B:
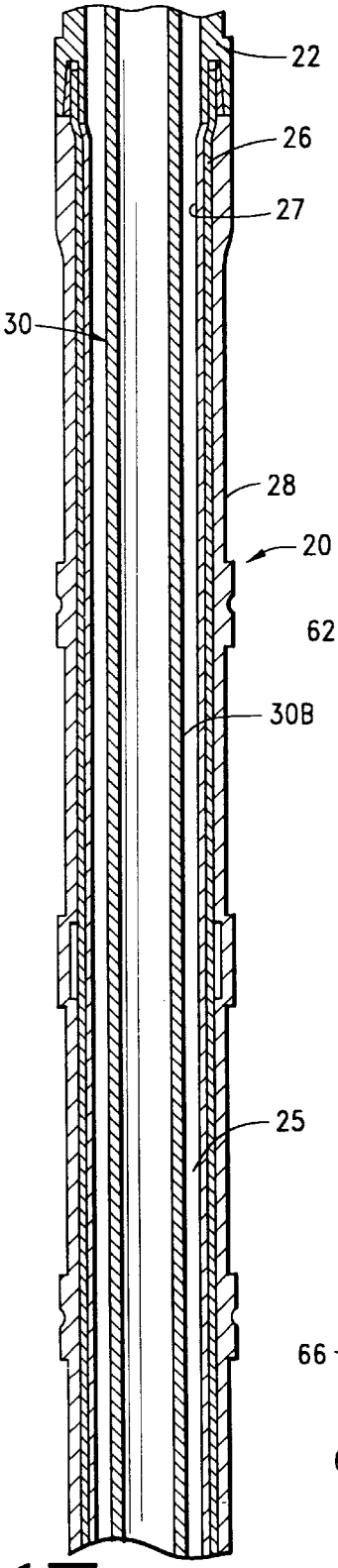
Figure 4C:
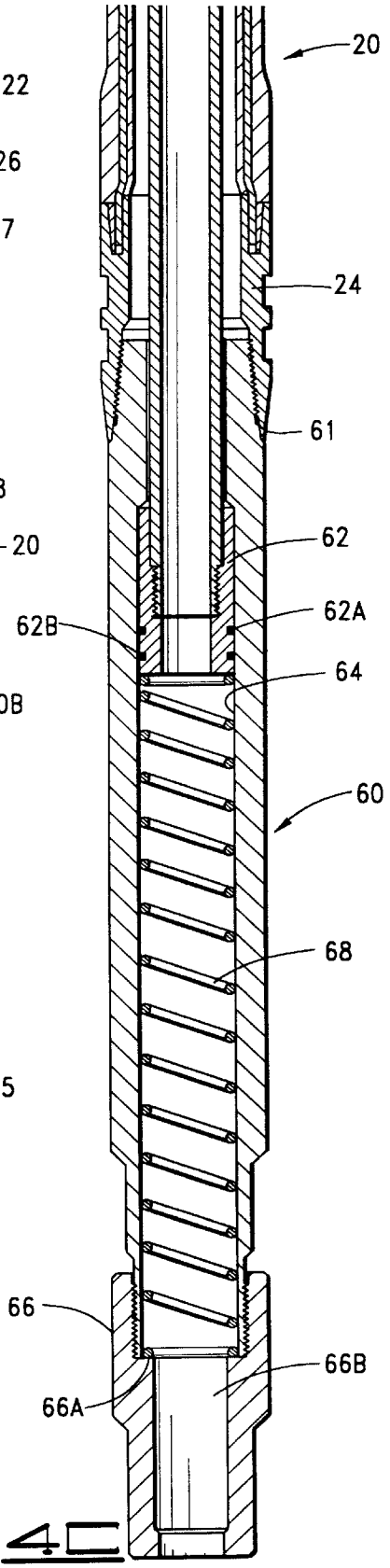

Referring now to FIGS. 4A through 4C, the stimulation tool 10 can be generally described as having a long, cylindrical shape with a longitudinal flow passageway extending therethrough. An inner mandrel 30, described below, and an inflatable packer element 20 are two of the principal components of the stimulation tool 10. Other components, which are concentrically aligned with and slidably connected to the inner mandrel 30, include an upper outer mandrel 40, comprising an upper mandrel 40A threadedly connected to a top sub 40B, and through the inflatable element 20 to a lower mandrel 60.

The inflatable packer element 20 may be any commercially available element, such as that shown on the CT™ resettable packer sold by TAM International which is presented on page 3318 of the 1990–1991 *Composite Catalog of Oil Field Equipment and Services,* published by World Oil, Houston, Tex.

Such inflatable packer elements typically comprise a layer of reinforcement material 26, such as metal braid either alone or together with a weave of cord. The cord may be either all natural fibers, all man-made fibers or a mixture of natural and man-made fibers. This reinforcement material is sandwiched between and bonded to an inner rubber bladder 27 which is compounded to provide fluid retention and to an outer rubber covering 28 which is compounded and designed to resist scuffing and tearing. The inner rubber bladder 27 and the outer rubber covering 28 may be of the same or different composition.

The upper end shoe 22 and the lower end shoe 24 are fixedly and sealingly attached to inflatable packer element 20. The upper end shoe 22 is threadedly attached to top sub 40B, described below, and sealed against leakage by o-ring 22A.

The lower end shoe 24 is threadedly and sealingly attached to the lower mandrel 60, described below, and cooperates with the upper end shoe 22 to dispose and retain the inflatable packer element 20 in position about the inner mandrel 30.

The tubular inner mandrel 30, which extends the entire length of inflatable packer element 20, has a longitudinal flow bore 30C therethrough and comprises a tubular upper seal mandrel 30A threadedly connected to a tubular lower inner mandrel 30B so that the flow bores of the upper seal mandrel 30A and the lower inner mandrel 30B are in flow registration with one another. One end of the upper seal mandrel 30A extends through the upper outer mandrel 40, described below, and provides means for attaching the stimulation tool 10 to a coiled tubing string M or to any other desired running tool, such as jointed pipe or the like.

A valve seat 32 is placed on a radially outwardly stepped shoulder 33 at the upper end of lower inner mandrel 30B. The valve seat 32 is retained in place on the stepped shoulder 33 by the cooperative engagement of box connector 34 which is formed distal to said shoulder with pin connector 35 of upper seal mandrel 30A. The valve seat 32 is sealed against fluid leakage by dual o-ring seals 36A, 36B. Radial flow ports 31 intersect the wall of the inner mandrel 30 intermediate the valve seat 32 and the threaded attachment point for collets 39, described below, to provide flow communication between the flow bore of the inner mandrel 30C and the exterior thereof.

Threadedly inserted into the upper seal mandrel 30A proximate a cylindrical indexing collar 82, described below, is at least one dual function travel limiting and guide slot lug 37 and at least one single function travel limiting lug 38. Each lug has an extended length head, 37A and 38A, respectively which is fitted with an o-ring seal to prevent fluid leakage therearound. Additionally, the dual function travel limiting and guide slot lug 37 has a pin end 37B formed adjacent the threaded portion thereof which extends beyond the inner wall of upper seal mandrel 30A.

A collar with a plurality of radially outwardly extended resilient collet fingers 39, hereinafter referred to as collets, depending therefrom is threadedly attached to the exterior of the upper seal mandrel 30A. When the tool is run into the hole, the collets 39 extend into cooperative engagement with lower detent 49B, described below.

The combination travel limiting and guide slot lug 37, has pin end 37B extending beyond the inner wall of the upper seal mandrel 30A and into engagement with the continuous J-slot 82A, shown in FIG. 5, which is on indexing collar 82. The single function travel limiting lug 38 has no such pin end and its threaded portion is sized not to extend beyond the inner surface of the wall of upper mandrel 30A. Extended length heads 37A, 38A extend beyond the exterior surface of upper seal mandrel 30A into cooperative engagement with travel limiting slots 48, 48A, which are longitudinally oriented slots cut through the upper mandrel 40A.

The cooperative engagement of the lug heads and the travel limiting slots limit the distance of longitudinal travel of the inner mandrel 30 relative to the upper outer mandrel 40.

A pair of parallel annular grooves are circumferentially cut into the interior wall of the upper mandrel 40A forming an upper detent 49A and a lower detent 49B on either side of a circumferential ring 50 which is formed on the interior surface of the mandrel as a result of cutting the circumferential grooves.

Intermediate the lower end of the lower detent 49B and the upper end of the top sub 40B, an annular groove 42 is cut into the inner circumference of the upper mandrel 40A thereby forming an indentation into which seals 44 are secured. Resistant backing for the seals 44 is provided by the interior wall of upper mandrel seal extension 40C. Seals 44 have an intermediate portion which allows flow therethrough.

The lower mandrel 60 is slidably disposed about the lower end of the lower inner mandrel 30B and retained thereon by the lower element seal assembly 62. The lower element seal assembly 62 is threadedly attached to the lower end of the lower inner mandrel 30B. Dual o-ring seals 62A, 62B slidably engage the polished inner bore 64 which traverses the entire length of lower mandrel 60 sealingly isolating the interior flow passage of lower mandrel 60 from annular space 25. A spring retainer 66, which also functions as a fluid discharge nozzle threadedly attaches to the lower end of the lower mandrel 60. The spring retainer 66 has a radially inwardly stepped shoulder 66A which engages the lower end of the element return spring 68 to retain the spring in the tool. The upper end of the spring 68 is retained by the lower end of the lower element seal assembly 62. The return spring 68 is in cooperative engagement with the lower element seal assembly 62 and the spring retainer 66. A fluid flow passage 66B through the spring retainer 66 provides communication for fluid flow between the interior of the stimulation tool 10 and the well bore B. O-Ring 61, which sealingly engages lower end shoe 24 as aforesaid is positioned in a groove about the external surface of lower mandrel 60 proximate the attachment point for said lower end shoe.

A velocity valve 70 is slidingly and sealingly positioned within the flow bore of the upper seal mandrel 30A and biased toward one end of the upper seal mandrel 30A by mandrel return spring 88.

The velocity valve 70 comprises a cylindrical velocity valve mandrel 72 which has an inlet 72A at one end thereof, an outlet 72B at the other end thereof and flow bore 72C connecting the inlet and the outlet. A discharge nozzle 74, described below, is threadedly connected by threads T1 to the outlet 72B. The external surface of the velocity valve mandrel 72 has an annular groove 80 on its surface adjacent the inlet 72A. The groove 80 receives the cylindrical indexing collar 82, and maintains the collar in rotating engagement with the velocity valve mandrel 72.

The discharge nozzle 74 has a smooth polished exterior sealing surface 74A for sealing the nozzle in valve seat 32 and an internal generally conical cross section 74D at its distal end.

A hydrostatic bleed port 74B in the distal end of the discharge nozzle 74 and a plurality of radially outwardly sloping flow ports 74C are spaced about the circumference of discharge nozzle 74. These ports provide flow communication between the flow bore 72C and the interior of the upper seal mandrel 30A.

Threadedly connected to the inlet 72A by threads T2 is a cylindrically shaped collar lock 76 which has a flow bore 76A therethrough in flow registration with flow bore 72C of the velocity valve 70. Flow bore 76A is sealingly isolated from the interior of upper seal mandrel 30A by an o-ring 76C which is retained in an external circumferential groove on collar lock 76. The collar lock flow bore 76A has an inlet formed by a radially inwardly sloping shoulder 76B. The collar lock 76 both retains the cylindrical indexing collar 82 in position on the exterior of the valve mandrel 72 and functions as a trash barrier to prevent well debris from lodging in the channel of the continuous J-slot 82A, shown in FIG. 5, which would inhibit the intended operation of the inflatable stimulation tool 10.

Radial inflation ports 84 intersect the velocity valve mandrel 72 intermediate the ends of the mandrel to establish flow communication between the longitudinal flow bore 72C and the exterior of valve mandrel 72. Stacked equalizing port seals 86 are disposed about the exterior of the velocity valve 70 intermediate the inflation ports 84 and the return spring 88. The return spring 88 is located in a spring housing 88A which is formed by a radially inwardly stepped shoulder 88B, located intermediate the valve seat 32 in inner mandrel 30 and lower seal retainer 86A. The lower seal retainer 86A forms the upper boundary of spring housing 88A and serves as a spring stop for the return spring 88.

The stimulation tool 10 is run into the hole with the inner mandrel 30 maintained in position by the engagement of the collets 39 with the lower detent 49B. The collets 39 are sized so that appreciable longitudinal force must be applied to the inner mandrel 30 to collapse the collets and move the inner mandrel 30 relative to the upper outer mandrel 40 either from a first lower position to a second upper position or from the second upper position to the first lower position.

When the inflatable packer element 20 is inflated into contacting engagement with either the casing A or production tubing F, the upper outer mandrel 40 becomes fixedly engaged with the interior surface of the casing A or production tubing F as a result of the frictional forces between the inflated packer element 20 and the face of the well bore. Once the inflatable packer element 20 is so engaged, it is possible to pull up on the coiled tubing M by means of the coiled tubing injector I thereby moving the inner mandrel 30 longitudinally upward with reference to the upper outer mandrel 40. This movement causes the collets 39 to deflect inwardly to pass over ring 50 until they arrive at and expand into the upper detent 49A, thereby securing the inner mandrel 30 against inadvertent downward movement relative to the upper outer mandrel 40.

The upper outer mandrel 40 comprises an upper mandrel 40A threadedly and sealingly attached to a top sub 40B proximate the seals 44. Upper seal mandrel extension 40C of the upper mandrel 40A and top sub extension 40D of the top sub 40B overlap each other when the upper mandrel 40A and the top sub 40B are threadedly connected. These unthreaded extensions are sized so that a spaced relationship is maintained between the two extensions thereby forming an upper portion of an inflation passage 46.

The inflation passage 46 extends from ports 45 which intersects upper seal mandrel extension 40C intermediate the seals 44 to an annular space 25 which is formed by the spaced relationship maintained between the inflatable packer element 20 and the inner mandrel 30.

Figure 10A:
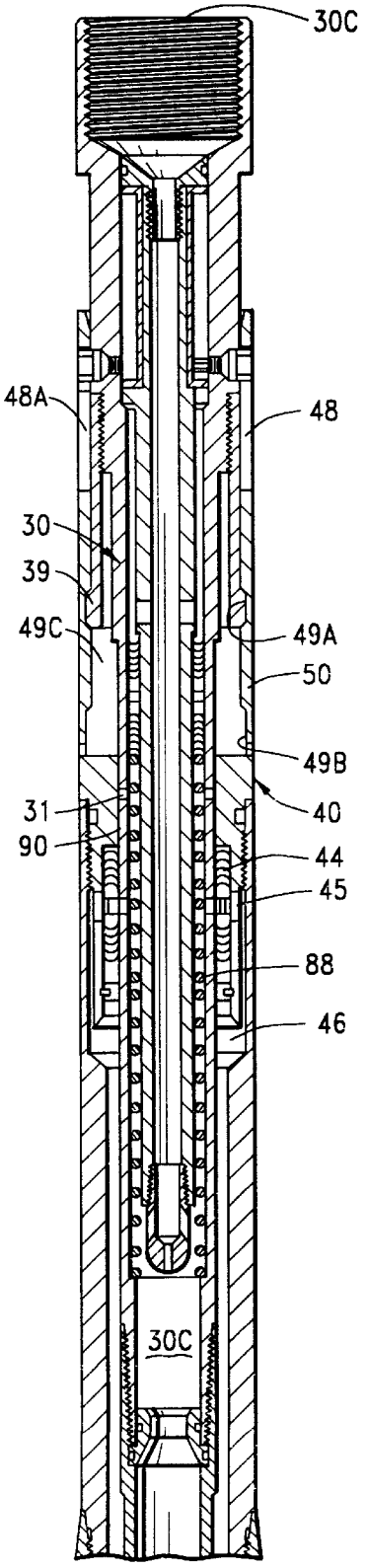
FIGS. 10A through 10C are sectional views of the stimulation tool showing the velocity valve in its first position, the element inflated, and the inflation ports closed.

Referring now to FIG. 10A, the stimulation tool 10 is provided with an equalization passage to facilitate the equalization of pressures within stimulation tool 10 with those in the well bore B above the inflatable packer element 20. This equalization is accomplished as a result of fluid leakage through ports 31 into equalization passage 90 and thence into annular space 49C. Annular space 49C is positioned in such manner to provide a locally enlarged inner radius in upper outer mandrel 40 in which collets 39 are free to flex. From the annular space 49C, fluid then flows around the collets 39 and ultimately into well bore B through travel limiting slots 48, 48A.

Method of Operation

When the stimulation tool 10 is run in the well bore B, the inflatable packer element 20, which is in cooperative engagement with the lower mandrel 60, will be maintained in close spatial relationship with the inner mandrel 30 by the biasing forces of the weight of the lower mandrel 60 and spring retainer 66, and the element return spring 68, as is shown in FIGS. 4B and 4C. As described above, use of the element return spring 68 is optional. This close spatial relationship minimizes the volume of the annular space 25 on run-in. The element return spring 68, which is in cooperative engagement with the lower mandrel 60 and with the lower element seal assembly 62, acts upon the lower mandrel to urge it into a first, extended position relative to the upper outer mandrel 40.

The stimulation tool 10 is run in the well by the coacting engagement of the coiled tubing M with the coiled tubing injector I which is controlled by the operator in the coiled tubing truck H.

Figure 6:
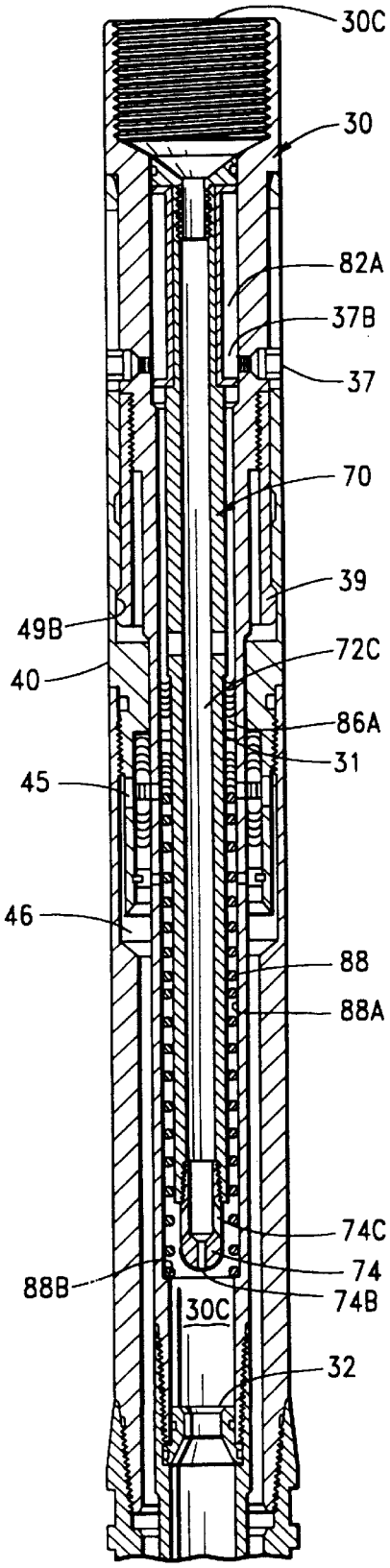
FIG. 6 is a sectional view of the upper portion of the stimulation tool with the velocity valve in its first, upper position and the outer mandrel inflation ports open (the low flow run-in position)

Referring now to FIG. 6, on run-in, the velocity valve 70 will be maintained in a first upper position within the inner mandrel 30 by the force exerted by return spring 88 coacting with the radially inwardly stepped shoulder 88B of spring housing 88A against the lower seal retainer 86A. The correct valve position is maintained by the cooperative engagement of pin end 37B which extends from the dual function travel limiting and slot guide lug 37, and J-slot 82A to maintain pin end 37B at location 82B, shown in FIG. 5. In this position, the discharge nozzle 74 is maintained within the boundaries of the spring housing 88A and remote from the valve seat 32.

The inner mandrel 30 is maintained in its first, lower position relative to the upper outer mandrel 40 by the engagement of the collets 39 with the lower detent 49B. In this first, lower position, the inner mandrel flow ports 31 are in flow registration with the ports 45. When the flow registration of flow ports 31 with ports 45 is achieved and establishes further flow communication with the inflation passage 46 and the annular space 25, the inflatable packer element 20 does not inflate, because the pressure in the well bore B is the same as, or greater than, the pressure in annular space 25. It may be desirable to pump fluid by pump O from reservoir P at the well surface, as shown in FIG. 1 through coiled tubing M and through stimulation tool 10 at a low flow rate, for example five gallons or less per minute during run-in. The relatively small volume of pumped fluid is generally sufficient to prevent the ingestion of well fluids or debris into the interior of the tool and circulates fluid ahead of the tool as it is lowered into the well, but it is not sufficient to inflate the packer element 20.

In the configuration described above and shown in FIG. 6, pumped fluid flows through the flow bore 72C of the velocity valve 70 and out of the valve through the radial flow ports 74C and through the hydrostatic bleed port 74B in discharge nozzle 74. The pumped fluid then flows out of the tool through flow bore 30C in inner mandrel 30 and through spring retainer 66.

In the more normal condition or in the event debris is encountered within well bore B which inhibits or prevents the introduction of the stimulation tool 10 into the well bore to the desired depth, the flow rate of the pumped fluid can be increased, for example, to 15 or more gallons per minute. This higher flow rate is usually sufficient to wash the debris from the well bore thereby allowing the stimulation tool 10 to be placed at the desired depth. Of course, it is understood that when the flow rate is increased as aforesaid, the pressure exerted by the pumped fluid within the coiled tubing M and within the stimulation tool 10 will also increase proportionately, as for example to 500 psi. For purposes of illustration, and not by limitation, 500 psi will be referred to as the "reference pressure" to provide a basis upon which flow measurements hereinafter mentioned will be predicated.

When fluid is pumped into stimulation tool 10 at an increased flow rate, the increased flow and pressure will create a longitudinally downward velocity driven force component which will react with the radially inwardly sloping shoulder 76B of the collar lock 76 and with conical cross section 74D of the discharge nozzle 74. This longitudinal force component both causes the cylindrical indexing collar 82 to rotate about the circumference of the velocity valve 70 and applies sufficient force to return spring 88 to overcome the force exerted by the return spring 88, thereby moving velocity valve 70 to its second, or intermediate position.

Figure 7:
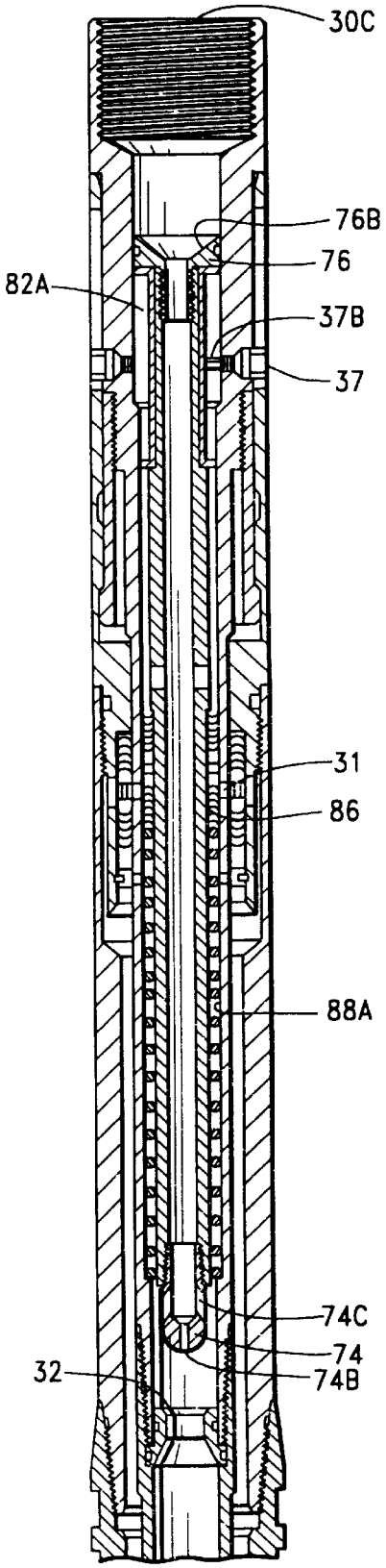
FIG. 7 is a sectional view of the upper portion of the stimulation tool with the velocity valve in its second, intermediate position and the outer mandrel inflation ports open (the high flow run-in position)
Figure 3:
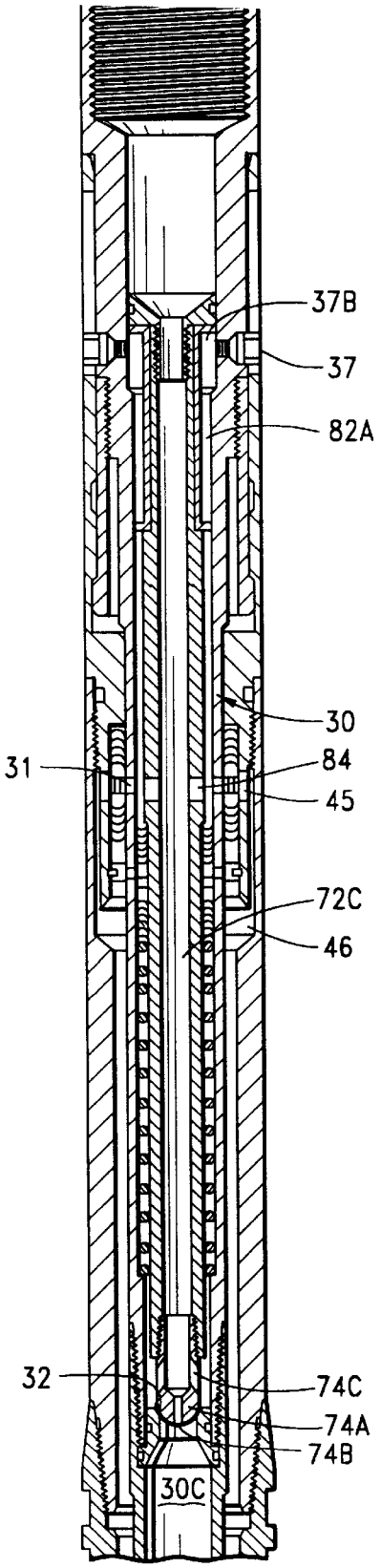
Figure 3:
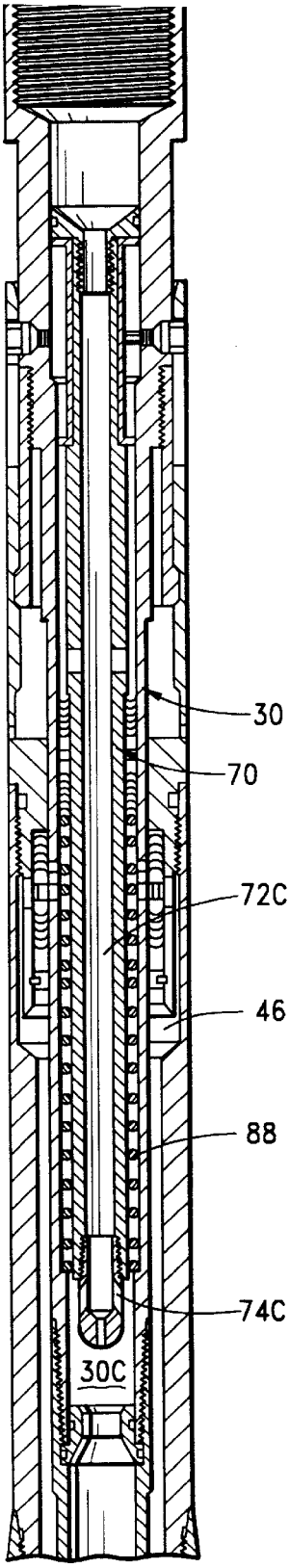

Referring now to FIG. 7, in this second, intermediate position, pin end 37B of the combination travel limiting and slot guide lug 37 is located at position 82 C of continuous J-slot 82A, as shown in FIG. 5. This second intermediate position also causes the radial flow ports 74C in the velocity valve discharge nozzle 74 to be positioned in the flow bore 30C of the inner mandrel 30 thereby continuing to allow unrestricted flow of fluids from the tool to the well bore B through the path described above. Also, in this second position, the stacked equalizing port seals 86 are positioned across the inner mandrel flow ports 31 thereby isolating the inflatable packer element 20 from the increased pressures and flows within the stimulation tool 10. In this position, it is possible to pump fluids through the inner mandrel 20 at any desired rate or pressure with the pumped fluid exiting stimulation tool 10 through spring retainer 66 without inflating the inflatable packer element 20.

Once the stimulation tool 10 is located at the desired position in the well bore B, as determined by measurement apparatus on the coiled tubing truck H at the surface, the operator stops movement of the coiled tubing M through the injector I. If the low flow rate described above has been used while the stimulation tool 10 was injected into the well bore B to the desired depth, the pump speed is increased to increase fluid pressure in coiled tubing M to the reference pressure. At the reference pressure, the flow rate and pressure through the coiled tubing M is sufficient to cycle the velocity valve 70 to the second, intermediate position as aforesaid.

The design of velocity valve 70 is such that a relatively low fluid velocity, as for example the velocity produced at a flow of 10 gallons per minute will generate sufficient force against radially inwardly sloping shoulder 76B of collar lock 76 and against conical cross section 74D of discharge nozzle 74 to cycle the velocity valve 70 to its second, intermediate position. When the movement of the velocity valve 70 to the second, intermediate position has occurred, the operator first notes the pressure and fluid flow rate as indicated on the instruments in the coiled tubing truck, then, the pump output is isolated from the flow path which decreases both the fluid pressure and the fluid velocity reacting on the velocity valve 70.

When the fluid pressure and flow rate is decreased, the fluid velocity reacting with the radially inwardly sloping shoulder 76B of the collar lock 76 and with the conical cross section 74D of the discharge nozzle is also decreased. This decrease in fluid velocity reduces the longitudinally downward force component, described above, which is coacting with these surfaces to force the velocity valve 70 into one of its lower positions.

As shown in FIGS. 4 through 9, the velocity valve 70 can be cycled into three different positions: (1) a first, upper position, in which pin end 37B of lug 37 is located at either position 82B or 82B' in J-Slot 82A, as shown in FIG. 5; (2) a second, intermediate position in which pin end 37B is located at position 82C; or (3) a third, lowermost position in which pin end 37B is located at position 82D.

J-Slot 82A is constructed so that velocity valve 70 must return to its first position before it can be cycled from its second position to its third position. Likewise the velocity valve 70 must move to its first position before it can be cycled from its third position to its second position.

Once the downward force component is less than the force exerted by the return spring 88, the return spring force causes the cylindrical indexing collar 82 to rotate about velocity valve mandrel 72, and the velocity valve 70 is urged upwardly into its first upper position shown in FIG. 6. As the velocity valve 70 moves upwardly to its first position, pin end 37B of lug 37 moves to position 82B', shown in FIG. 5.

When it is desired to begin the stimulation job, fluids are pumped from the reservoir P through the coiled tubing M to the stimulation tool 10. Fluid Q, delivered by pump 0 on the coiled tubing truck H, is once again pumped at a relatively high flow rate as, for example 15 gallons or more per minute. As the flow rate is once again increased, fluid velocity is also increased as aforesaid. This increase in fluid velocity once again increases longitudinally downward forces acting on the velocity valve 70 overcoming the force exerted by the return spring 88 thereby both causing continuous J-slot 82A to rotate about the external surface of velocity valve mandrel 72 and urging velocity valve 70 to move longitudinally within the mandrel 30 to its third, lowermost position. In this position, pin end 37B moves to position 82D of continuous J-slot 82A, as shown in FIG. 5.

Referring now to FIG. 8, in this third, lowermost position, the velocity valve 70 has moved longitudinally downward within the inner mandrel 30 so that the smooth polished sealing surface 74A of discharge nozzle 74 is in sealing engagement with valve seat 32. This sealing engagement isolates flow ports 74C from communication with the flow passage 30C of inner mandrel 30. Also, this third position of velocity valve 70 places radial inflation ports 84, which intersect velocity valve mandrel 72, into flow registration with flow ports 31 in the inner mandrel 30 and with ports 45 in the upper outer mandrel 40. The alignment of the three ports operates to flowingly connect the annular space 25 between the inner mandrel 30 and the inflatable packer element 20 with the flow bore 72C of velocity valve 70 by means of inflation passage 46. Since hydrostatic bleed port 74B is of minimal size and radial flow ports 74C are sealingly isolated from flow bore 30C of inner mandrel 30, substantially all of the fluid pumped down coiled tubing M is directed to annular space 25 to effect the inflation of inflatable packer element 20. The fluid which is pumped through port 74B may cause difficulties in some situations wherein the formation will not allow fluids Q to be pumped into perforations D at a relatively high rate. In those situations a pressure bleed structure 350 (see FIGS. 16A and 16B), described hereinbelow, may be necessary to achieve successful inflation of packer 20.

As inflatable packer element 20 inflates, its overall length decreases proportionately. As the length decreases, lower mandrel 60 is pulled upwardly from its first position to a second position which is more central to the tool. This upward motion compresses and charges element return spring 68, which is engaged by lower element seal assembly 62 and spring retainer 66, and raises spring retainer 66 to a second, compressed position relative to upper outer mandrel 40.

Figure 10B:
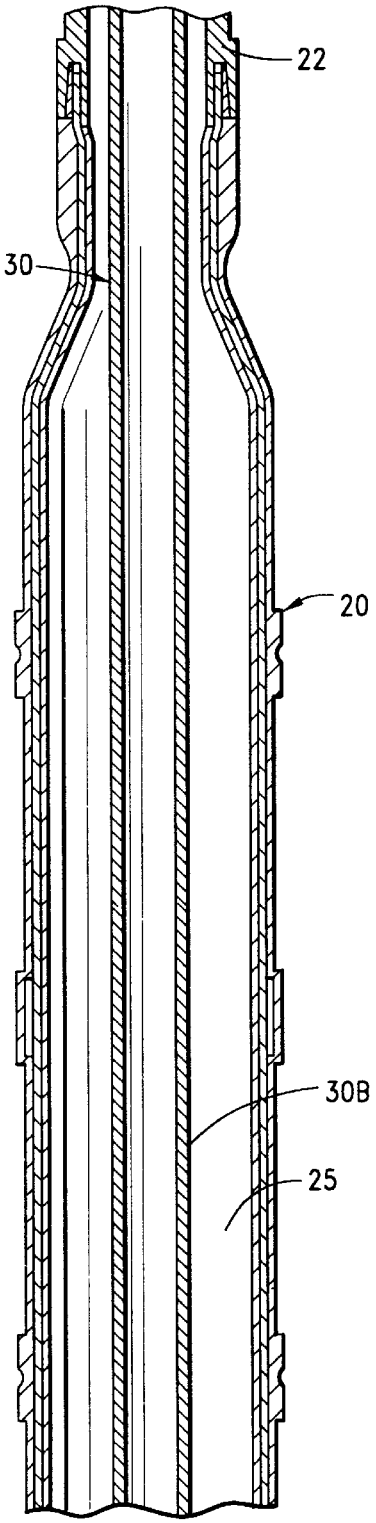
Figure 10C:
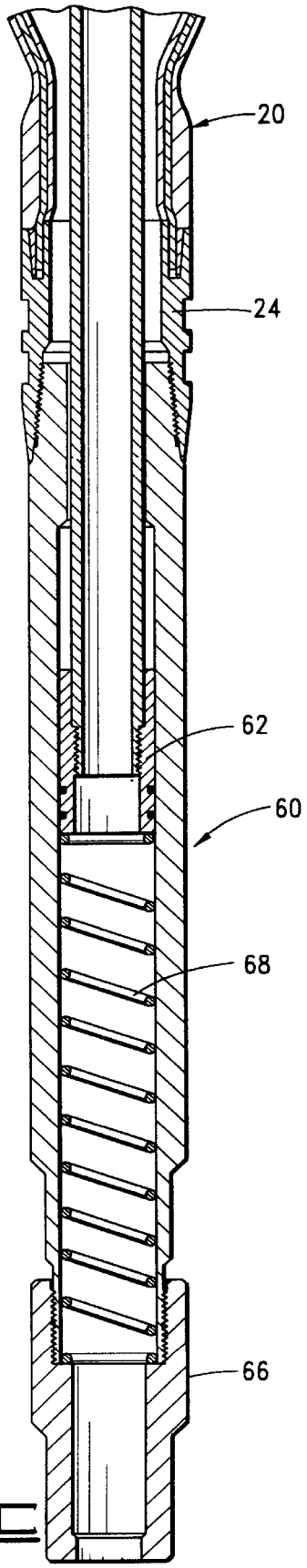

Referring now to FIGS. 10A, 10B and 10C, with pump O operating at sufficient speed to generate the reference pressure, when inflatable packer element 20 is inflated into contacting and sealing engagement with casing A or production tubing F, not shown, this engagement is indicated to the operator at the surface by both a rise in pressure within the coiled tubing M and by a decrease in flow rate, for example to 10 gallons per minute or less. When the operator receives the engagement signal, he causes the coiled tubing M to be pulled upwardly by injector I thereby moving the inner mandrel 30 longitudinally upward with reference to the upper outer mandrel 40 from its first lower position to its second upper position.

As the inner mandrel 30 is pulled upwardly, the collets 39 are collapsed inwardly to pass over ring 50 and move from the lower detent 49B to the upper detent 49A. This motion of the inner mandrel 30 to its second, upper position relative to the upper outer mandrel 40 and that the inflatable packer element 20 has inflated into contact with casing A or production tubing F, is indicated to the operator by an increase in weight as shown on the weight indicator in the coiled tubing truck H. The relative motion of the mandrels also moves flow ports 31 from flow registration with ports 45 and into flow registration with equalization passage 90. In addition, this movement also interposes the upper portion of seals 44 between ports 31 and ports 45 thereby sealingly isolating inflation passage 46 from the flow bore 30C of inner mandrel 30 and flow bore 72C of the velocity valve 70 to prevent undesired deflation of inflatable packer element 20. Also, because velocity valve 70 is in its third, lowermost position when fluid Q is still being pumped at a relatively high flow rate, as shown in FIG. 8, the relative movement of the mandrels also places inflation ports 84 of velocity valve 70 into flow registration with equalizing passage 90.

When inflation ports 84 are placed into flow registration with equalizing passage 90 as aforesaid, a flow passage is established between the inner bore 30C of inner mandrel 30 and the annulus between the exterior of coiled tubing M and the interior of casing A or production tubing F. As soon as this occurs, a rapid dump of internal pressure within the coiled tubing M occurs, which is indicated to the operator at the surface. This signal informs the operator that the inflation of the inflatable packer element 20 has been successfully completed and that fluid circulation has been established between the inner bore 30C and the annulus between the exterior of coiled tubing M and the interior of casing A or production tubing F.

After the aforesaid pressure dump occurs, pump 0 is isolated from the flow path and the fluid velocity is decreased within the stimulation tool 10. As the force of return spring 88 again becomes sufficient to overcome the velocity of the fluid flowing through stimulation tool 10, the velocity valve 70 returns to its first position as shown in FIG. 10A.

It must be noted that drag force must be applied to the upper outer mandrel 40 before inner mandrel 30 can be moved relative thereto. Therefore, the inflatable packer element 20 can only be sealed against deflation after it has first been inflated, since the inflated packer element 20 supplies the required drag force as a result of its contacting engagement with the casing A or production tubing F.

Once inflatable packer element 20 has been sealed and pressures within coiled tubing M have once again returned to a low steady state, indicating that velocity valve 70 is in its first, upper position, the stimulation tool 10 is in condition to commence the stimulation job. With the velocity valve 70 in its first, upper position, inflation ports 84 are sealingly isolated from ports 31.

Pump O is reinserted into the flow path and stimulation fluids Q are introduced into the coiled tubing M once again increasing the fluid flow rate through the coiled tubing.

Referring now to FIG. 9, when fluid velocities increase sufficiently to overcome the force of return spring 88, velocity valve 70 moves to its second, intermediate position as aforesaid. In situations where the formation will not allow a relatively high flow rate of fluids Q into perforations D, it may be necessary to use a pressure assist configuration 300 (see FIG. 15), described hereinbelow, to assist in moving velocity valve mandrel 72.

The second, intermediate position places radial flow ports 74C in flow registration with the flow bore 30C of inner mandrel 30. Since inflation passage 46 is sealingly isolated from flow bore 30C and from flow bore 72C of velocity valve 70, substantially all of the stimulation fluids Q are pumped through the coiled tubing M into flow bore 72C of the velocity valve 70. From flow bore 72C, the stimulation fluid Q then flows through radial flow ports 74C out of the velocity valve 70, through inner mandrel flow bore 30C and out of the stimulation tool 10 into the well bore B as shown in FIG. 2. That the velocity valve 70 is in the second, intermediate position, sometimes referred to as the stimulation position, is indicated to the operator by a higher rate of flow at the pump reference pressure than when the velocity valve 70 is in the first, upper position.

After the stimulation work has been completed, pump pressure is once again reduced, thereby allowing velocity valve 70 to return to its first position 82B'. As shown in FIGS. 10A, 10B and 10C in this configuration, flow registration is established between flow bore 30C of inner mandrel 30 and the exterior of the tool above the inflated packer element 20 by means of flow ports 31 and equalization passage 90 through annular space 49C. Since flow bore 30C is in communication with the well bore B below the inflated packer element 20, and annular space 49C is in communication with the well bore above the inflated packer element, pressures in the well bore become equalized on either side of the inflated packer element.

Referring again to FIGS. 4A, 4B, and 4C, the operator then applies weight to the coiled tubing M by means of the coiled tubing injector I to shift the inner mandrel 30 from its second, upper position longitudinally downward with respect to upper outer mandrel 40 to its first, lower position. This action restores flow registration between ports 31, ports 45 and inflation passage 46 which, under low pressure conditions, allows inflatable packer element 20 to deflate. As inflatable packer element 20 deflates, its diameter decreases and its overall length correspondingly increases. When the length increases, charged return spring 68 exerts a downward force on the lower mandrel 60 moving the lower mandrel from its second, compressed position back to its first, extended position which is remote from upper outer mandrel 40. As the lower mandrel 60 moves to its first position, the inflatable packer element 20 is urged to resume the close spatial relationship with inner mandrel 30 which it had on run-in.

The deflation of inflatable packer element 20 is indicated to the operator on the surface by an increase in weight on the weight indicator which is caused by the stimulation tool 10 becoming disengaged from the wall of the casing A or production tubing F and hanging freely on the end of coiled tubing M. Substantially complete deflation of inflatable packer element 20 is signaled to the operator by a return of internal coiled tubing pressure to a low steady state. When the inflatable packer element 20 has fully deflated, the stimulation tool 10 is in condition to either be moved to another location in well bore B to repeat the stimulation operation or to be retrieved from the well.

First Alternate Embodiment

Figure 3A:
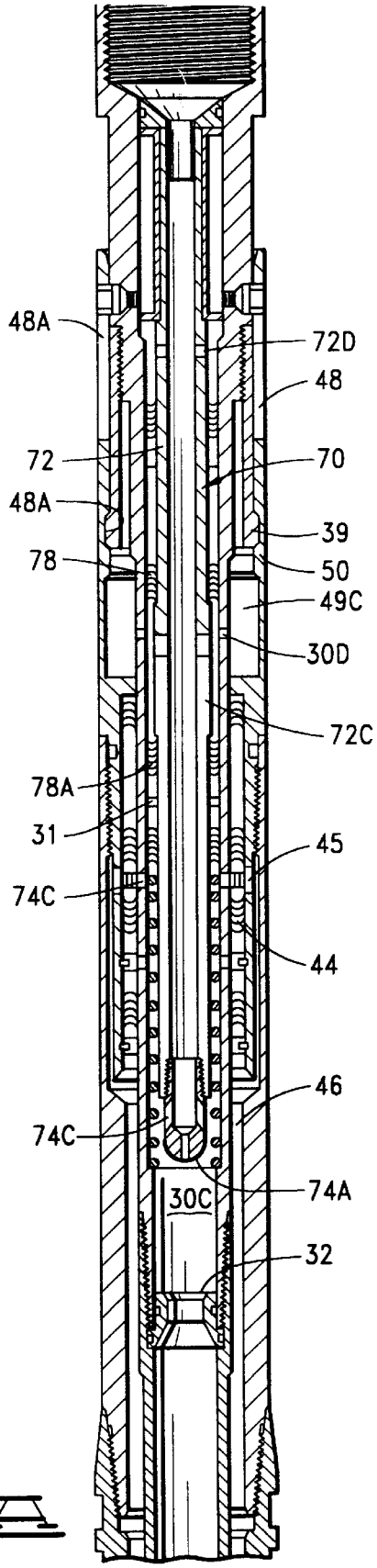
FIGS. 3A through 3C are sectional views of an alternative embodiment of the stimulation tool.
Figure 3B:
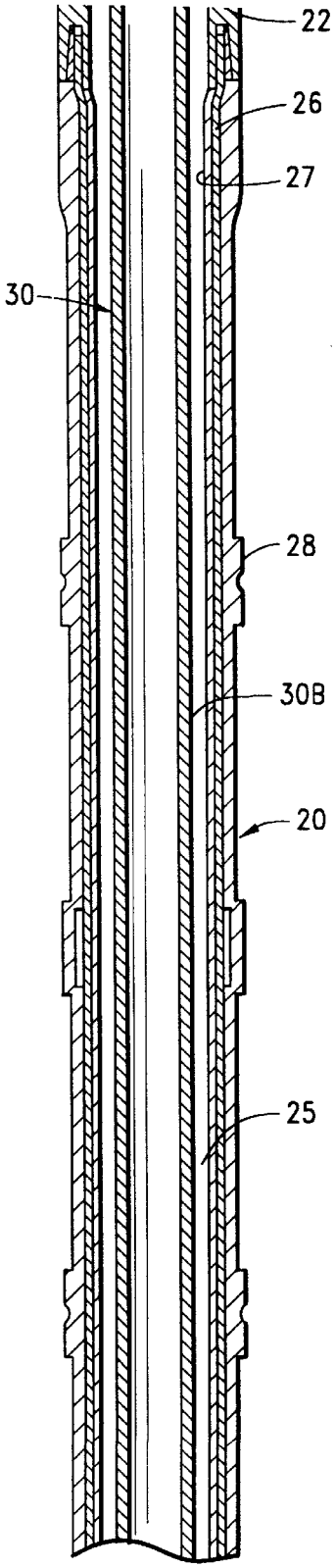
Figure 3C:
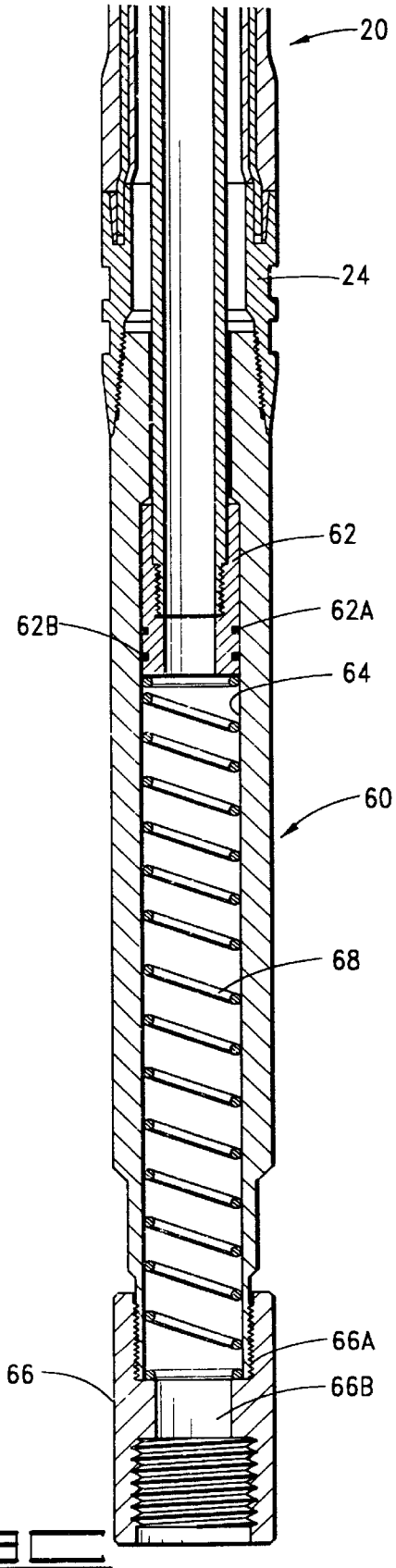

Referring now to FIGS. 3A, 3B and 3C, in an alternative embodiment, the tool can be run into the well bore B with the collets 39 on inner mandrel 30 positioned in the upper detent 49A. To seal the inflatable packer element 20 after it has been inflated, this embodiment requires that the operator set down weight on the coiled tubing M to collapse the collets 39 and allow them to pass over the ring 50 into the lower detent 49B. This action removes the inner mandrel ports 31 from flow registration with the outer mandrel ports 45. It also interposes the seals 44 between ports 31 and ports 45, thereby sealingly removing the inflation passage 46 from flow registration with both the inner mandrel flow bore 30C and the velocity valve flow bore 72C. As in the preferred embodiment, this sealing of the inflation passage 46 also seals inflatable packer element 20 against inadvertent deflation.

In this embodiment, the velocity valve 70 has radial equalizing ports 72D which intersect the velocity valve mandrel 72 and provide flow communication between the velocity valve flow bore 72C and the inner mandrel flow bore 30C. The velocity valve mandrel 72 is also intersected radially by the inflation ports 84 as described above.

The inner mandrel 30 has equalizing ports 30D which provide flow communication between the flow bore of the inner mandrel 30C and annular space 49C. When the alternative embodiment is in the equalization position shown in FIG. 3A, fluid is permitted to flow from the flow bore 30C, through the radial flow ports 74C, flow bore 72C, the inflation ports 84, and through the equalizing ports 30D into annular space 49C. From annular space 49C, fluid then flows around the collets 39 and through the travel limiting slots 48, 48A into the well bore B.

As shown in FIG. 3A, in order to avoid the unintentional bleeding of internal pressure to the exterior of the tool during either inflation or stimulation, velocity valve 70 has equalizing port seals 78, 78A mounted in spaced relationship to each other and disposed about the external circumference of velocity valve mandrel 72 intermediate the radial inflation ports 84 and radial equalizing ports 72D.

When the velocity valve 70 is cycled to the inflation position, wherein the velocity valve is in its third, lowermost position and the smooth polished sealing surface 74A of discharge nozzle 74 is in sealing engagement with the valve seat 32, the inner mandrel ports 31, ports 45 and inflation ports 84 are in flow registration with each other. This flow registration establishes communication between the inner mandrel flow bore 30C through the inflation passage 46 and the annular space 25. In these positions of the velocity valve 70 and mandrels 30,40, the equalizing port seals 78, 78A are positioned so that the equalizing ports 30D are intermediate the equalizing port seals 78,78A and thereby sealingly isolated from the velocity valve flow bore 72C. All other structures, functions and positions of the various tool components previously described, except those described in this section are equivalent to those in the Preferred Embodiment described above.

Second Alternative Embodiment

Figure 11A:
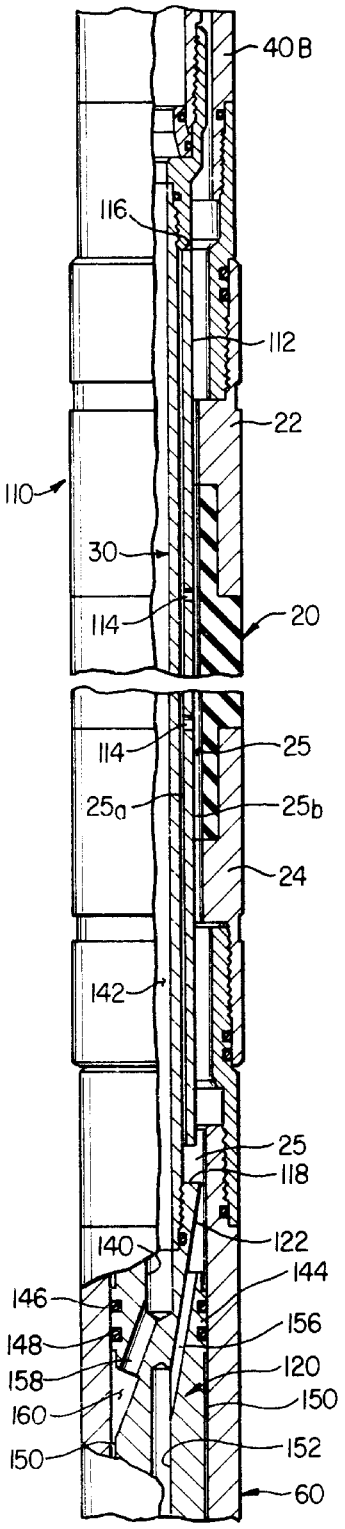
FIGS. 11 through 11C are downwardly successive quarter-sectioned longitudinal portions of a lower part of a second alternate embodiment of the inflatable stimulation tool.
Figure 11B:
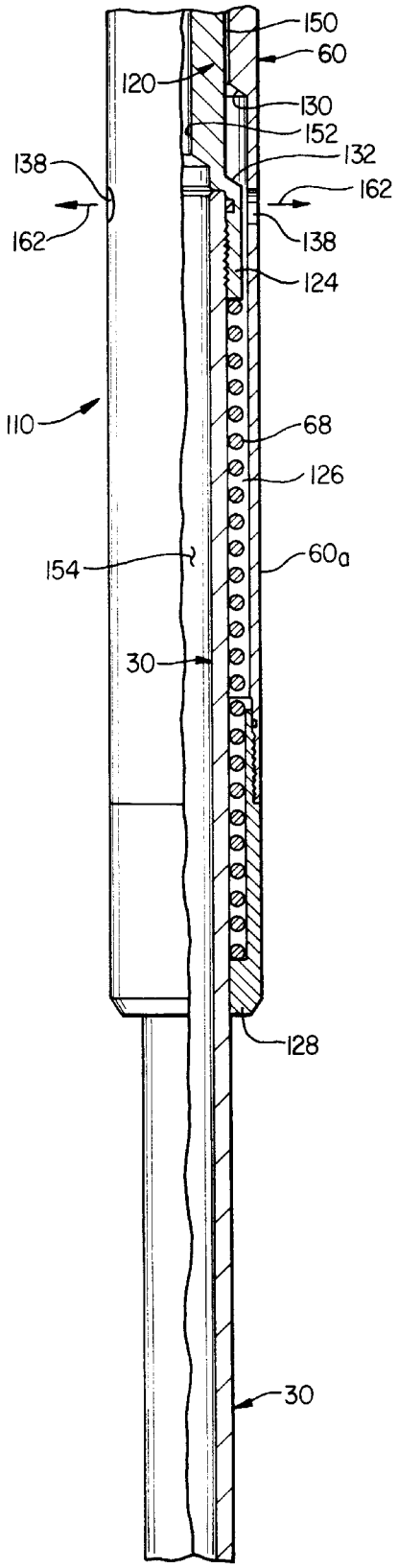
Figure 11C:
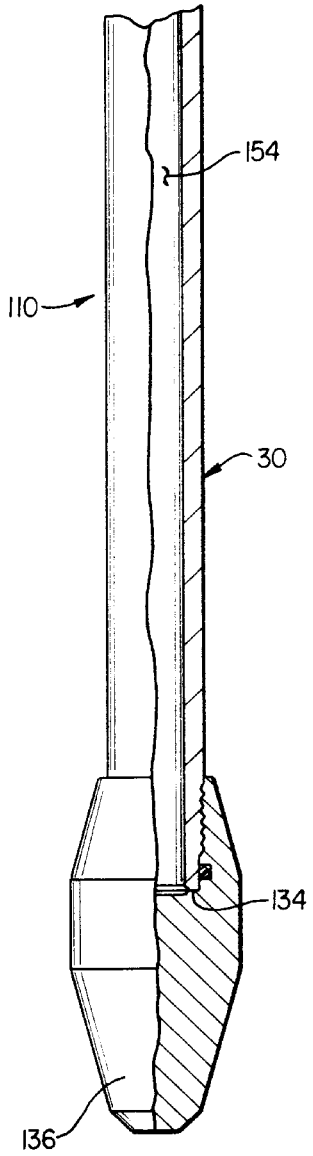

Cross-sectionally illustrated in FIGS. 11A–11C are downwardly successive longitudinal portions of the bottom section of a second alternative embodiment 110 of the previously described inflatable stimulation tool 10. The upper section of the modified stimulation tool 110 is identical to the upper section of the tool 10 shown in FIG. 4A, and parts in the tool 110 similar to those in the tool are given identical reference numerals for ease of comparison of the two tools.

As previously described in conjunction with the inflatable stimulation tool 10, when inflation fluid is forced downwardly into the annulus 25 between the packer 20 and the inner mandrel 30 (see FIG. 11A) the packer 20 is inflated and radially extended. An inflation-related problem that sometimes occurs is that during its inflation the annular upper portion of the packer 20 sometimes forms a seal with the outside surface of the inner mandrel 30. When this occurs, undue fluid pressure forces can be exerted on the unadhered upper packer portion and it can block the transfer of inflation fluid to the portion of the packer beneath the point where the seal is effected, thereby hindering proper full inflation of the packer.

In the inflatable stimulation tool 110 this potential packer inflation problem is substantially eliminated by the installation of an inflation fluid bypass tube 112 in the annulus 25 between the packer 20 and the inner mandrel 30. Tube 112 coaxially circumscribes the inner mandrel 30 and has an inner diameter somewhat greater than the outer diameter of the inner mandrel 30, and an outer diameter somewhat smaller than the inner diameter of the inflatable packer 20. A longitudinally spaced series of side wall perforations 114 are formed in the bypass tube 112, and the tube longitudinally "floats" in the annulus 25 between vertically spaced annular stop surfaces 116,118 carried on the inner mandrel structure 30.

As illustrated, the bypass tube 112 forms in the inflation fluid flow annulus 25 an inner subannulus 25*a* between the tube 112 and the inner mandrel 30, and an outer subannulus 25*b* disposed between the tube 112 and the packer 20 and communicating with the subannulus 25*a* via the tube perforations 114 and (depending upon the vertical orientation of the tube 112) around the ends of the tube 112.

During initial downflow of pressurized inflation fluid through the subannulus 25*b* the packer 20 begins to inflate. In the event that an upper portion of the packer 20 seals to the tube 112, the inflation fluid simply bypasses the adhered portion, via the subannulus 25*a*, and reenters the subannulus 25*b* below the adhered packer portion and exerts radial inflation pressure on the packer 20 at points spaced along its length via the side wall perforations 114. The bypass tube 112 accordingly serves to assure an even distribution of inflation pressure to the packer 20 despite any tendency it may have to initially adhere to the outside surface of the tube 112.

For purposes later described, a tubular crossover structure 120 (see FIGS. 11A and 11B) is operatively interposed in the inner mandrel structure 30. The crossover structure 120 has an upper end 122 that is threaded onto the lower end of the portion of the inner mandrel 30 shown in FIG. 11A, and a lower end 124 that is threaded onto the upper end of the portion of the inner mandrel 30 shown in FIG. 11B. The tubular upper end 122 of the crossover structure 120 defines the previously mentioned annular stop surface 118, and the tubular lower end 124 of the crossover structure 120 engages the top end of the return spring member 68. As with the previous embodiments, return spring 68 may be left out of the tool 110 assembly if desired.

The spring member 68 coaxially circumscribes the inner mandrel 30 and is disposed in an annular space 126 defined between the inner mandrel 30 and a radially thinned portion 60*a* of the outer mandrel 60. The bottom end of the spring member 68 bears against an inturned annular lip portion 128 at the lower end of the mandrel portion 60*a*. At the upper end of the mandrel portion 60*a* is an annular, downwardly facing interior shoulder 130 that faces and acts as a vertical stop surface for an upwardly facing annular shoulder 132 formed on the crossover structure 120.

In the previously described inflatable stimulation tool 10, stimulation fluid Q is discharged from an open lower end of the tool via nozzle 66 as shown in FIG. 4C. However, in the tool 110 shown in FIGS. 11A–11C the lower end 134 of the portion of the inner mandrel 30 projecting downwardly beyond the lower mandrel lip portion 128 (see FIGS. 11B and 11C) is closed off by an end cap member 136 threaded onto the inner mandrel lower end 134, and a series of stimulation fluid discharge ports 138 are circumferentially spaced around the lower mandrel portion 60*a* vertically adjacent the crossover structure shoulder 132.

Referring now to FIG. 11A, the upper end 122 of the crossover structure 120 has a vertical bore 140 extending downwardly therein and communicating with the interior 142 of the section of the inner mandrel structure 30 above the tubular crossover structure 120. Below its upper end 122 the crossover structure 120 has an enlarged cylindrical body portion 144 that slidingly engages the interior side surface of the lower mandrel 60 and is sealed thereto by a pair of O-rings 146 and 148. Beneath the enlarged body portion 144 the diameter of the crossover structure 120 is reduced to form an annulus 150 between the crossover structure 120 and the inner side surface of the lower mandrel 60. As illustrated in FIG. 11B, the lower end of the annulus 150 opens into the annular space 126 within which the spring member 68 is disposed.

An axial bore 152 extends upwardly through a lower end portion of the crossover structure 120 and has an upper end downwardly spaced apart from the lower end of the bore 140. The lower end of the bore 152, as illustrated in FIG. 11B, communicates with the interior of the portion of the inner mandrel structure 30 below the crossover structure 120. A first vertically sloped bore 156 downwardly enters the crossover structure 120 generally at the juncture of its upper end portion 122 and its enlarged body portion 144 and extends into the bore 152 to thereby communicate the annular space 25 with the interior 154 of the section of the inner mandrel 30 below the crossover structure 120.

A second vertically sloped bore 158 extends from the lower end of the bore 140 through the body portion 144 and opens into a radially inset portion 160 of the crossover structure 120 disposed beneath the enlarged body portion 144 and its O-ring seals 146,148. The interior of the radially inset portion 160, in turn, communicates with the annular space 126 (see FIG. 11B) via the annulus 150 between the crossover structure 120 and the inner side surface of the lower mandrel 60.

The crossover structure 120 creates within the inflatable stimulation tool 110 two internal passages which, via the O-rings 146 and 148, are sealingly separated from one another. The first internal passage is an inflation fluid flow passage and, from top to bottom in FIGS. 11A–11C, includes the annulus 25, the crossover structure bores 156 and 152, and the inner mandrel structure interior space 154 beneath the crossover structure 120. The second internal passage is a stimulation fluid flow passage and, from top to bottom in FIGS. 11A–11C, includes the interior 142 of the section of the inner mandrel 30 above the crossover structure 120, the crossover structure bores 140 and 158, the radially inset portion 160 of the crossover structure, the annulus 150 and the annular space 126.

During the packer inflation cycle (as previously described in conjunction with the stimulation tool 10), pressurized inflation fluid is forced downwardly through the annulus 25, and into the balance of the inflation fluid flow passage closed off at its lower end by the end cap 136, to inflate the packer 20. During a subsequent stimulation cycle the flow of pressurized fluid (as previously described in conjunction with the stimulation tool 10) is prevented from entering the annulus 25 and is flowed instead downwardly through the stimulation fluid flow path. The pressurized fluid being forced downwardly through the stimulation fluid flow path enters the annular space 126 (see FIG. 1lB) and is forced outwardly through the stimulation fluid outlet ports 138 as indicated by the arrows 162.

Straddle Packer Embodiment of the Stimulation Tool

In accordance with a further aspect of the present invention, the single packer stimulation tool 110 described in conjunction with FIGS. 11A–11C may be converted to the straddle packer stimulation tool 170 schematically depicted in FIG. 12 by removing the end cap 136 from the lower end 134 of the inner mandrel structure 30 (see FIG. 1C) and connecting to the lower end of the inner mandrel structure 30 the additional stimulation tool components shown in FIGS. 13B–13F as later described. Downwardly successive longitudinal portions of the straddle packer embodiment 170 of the stimulation tool are shown in FIGS. 13A–13F, with the upper longitudinal portion of the tool 170 being identical to the upper portion of the previously described tool 10 as shown in FIG. 4A.

Figure 13A:
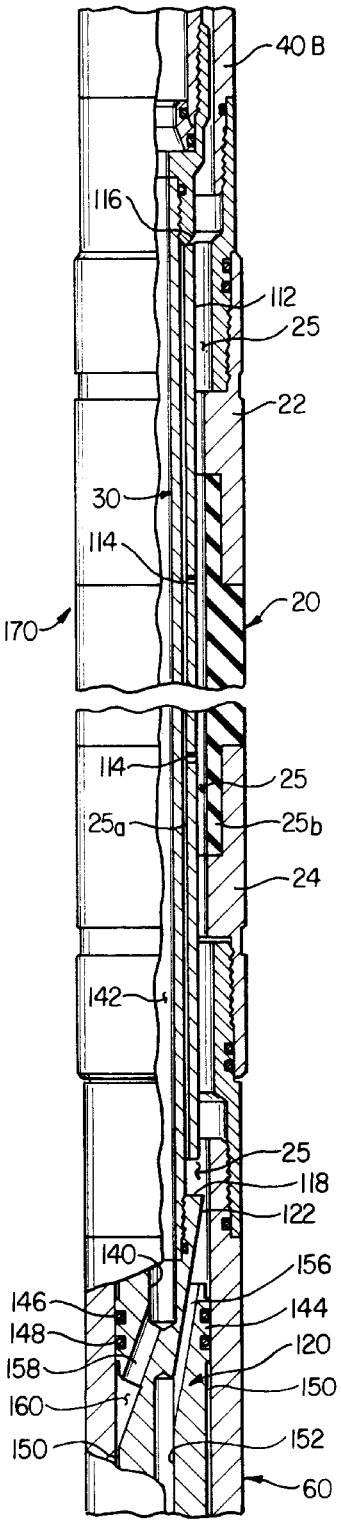
FIGS. 13A through 13F are downwardly successive quarter-sectioned longitudinal portions of a lower part of the straddle packer embodiment of the tool, with a telescoping expansion joint section of the tool in its retracted position.
Figure 13B:
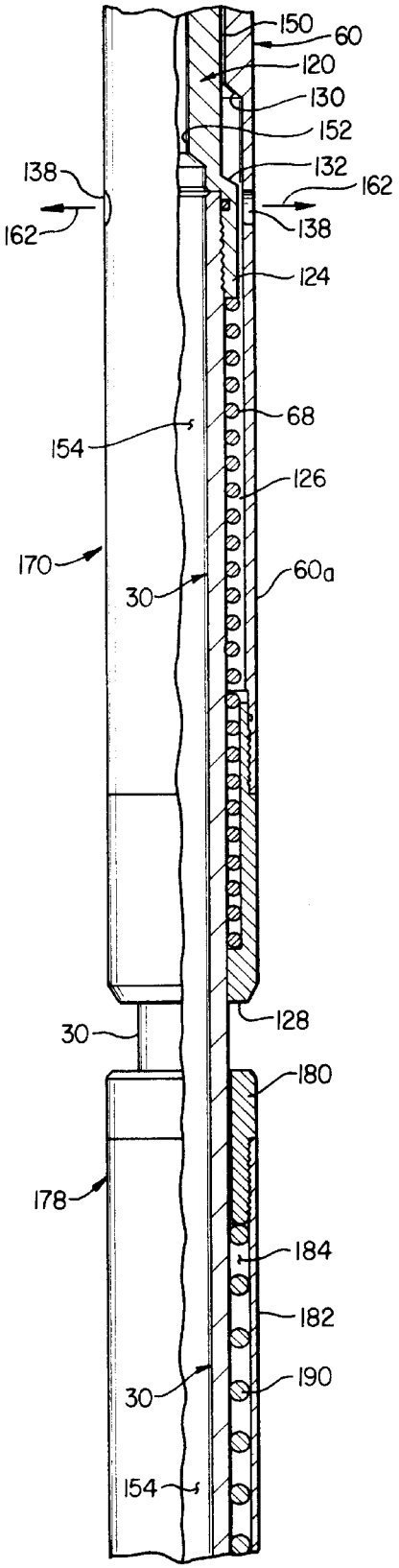

The longitudinal portion of the tool 170 shown in FIG. 13A and an upper section of the portion of the tool 170 shown in FIG. 13B are identical to the corresponding portions of the tool 110 shown in FIGS. 11A and 11B and include the inflatable packer 20, the inner mandrel 30, the lower mandrel 60, the perforated bypass tube 112, and the crossover structure 120. The lower end 134 of the inner mandrel 30 (see FIG. 13C) is secured to the upper end of an inner mandrel extension member 172 having a lower end 176 (see FIG. 13D) by means of an internally threaded tubular coupling member 174, the inner mandrel extension 172 forming therein a downward continuation of the interior of the inner mandrel 154.

Outwardly circumscribing the inner mandrel portions 30 and 172, below the annular lip portion 128 of the outer mandrel section 60*a* (see FIGS. 13B–13D), is a telescoping longitudinal expansion joint structure 178. The expansion joint structure 178 includes, at its upper end, an externally threaded tubular coupling member 180 that circumscribes the inner mandrel 30, is slidable along its length, and is threaded into the upper end of a tubular expansion joint upper body section 182 that outwardly circumscribes the inner mandrel 30 and defines around its outer side an annular space 184.

Figure 13C:
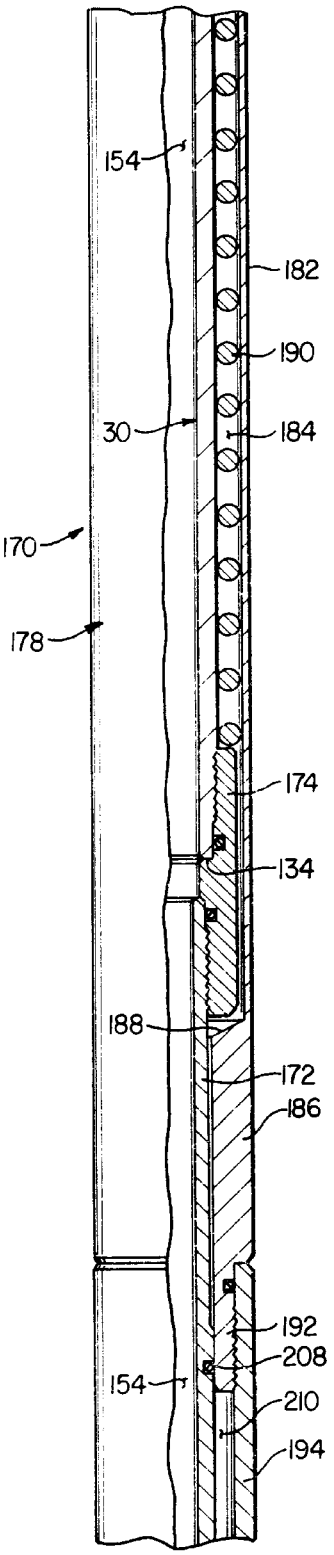

The body section 182 has a radially inwardly thickened bottom end portion 186 with an annular, upwardly facing interior ledge 188 that underlies the bottom end of the coupling 174 (see FIG. 13C).

A coiled compression spring member 190 is disposed within the annular space 184, circumscribes the inner mandrel 30, and respectively bears at its upper and lower ends against the couplings 180 and 174. Spring 190 resiliently biases the expansion joint upper body section 182 upwardly along the inner mandrel toward its retracted position shown in FIGS. 13B and 13C.

A radially inwardly thinned lower end portion 192 of the expansion joint upper body section 182 is threaded into an upper end of a lower tubular expansion joint body section 194 having, at its lower end (see FIG. 13D) a radially inwardly thickened section 196. At the upper end of the thickened section 196 is an upwardly facing annular interior ledge 198 outwardly through which a vacuum relief port 200 extends. The lower end 176 of the inner mandrel extension member 172 is slidingly sealed to the inner side surface of the thickened section 196 by means of an O-ring seal member 202 carried by the lower mandrel end 176.

Somewhat above the seal 202 the inner mandrel extension member 172 has a radially outwardly thickened annular portion 204 having a downwardly facing annular ledge 246 thereon which faces the upwardly facing annular ledge 198 at the vacuum relief port 200. The thickened annular portion 204 is slidingly sealed to the interior side surface of the lower body portion 194 by means of an O-ring seal 206 externally carried on the thickened portion 204. The diameter of the O-ring seal 206 is slightly larger than the diameter of the O-ring seal 202. The inner mandrel extension member 172 is also slidingly sealed to the interior side surface of the lower end portion 192 of the expansion joint body member 182 by means of an O-ring seal member 208 externally carried on the extension member 172 (see FIG. 13C).

Figure 13D:
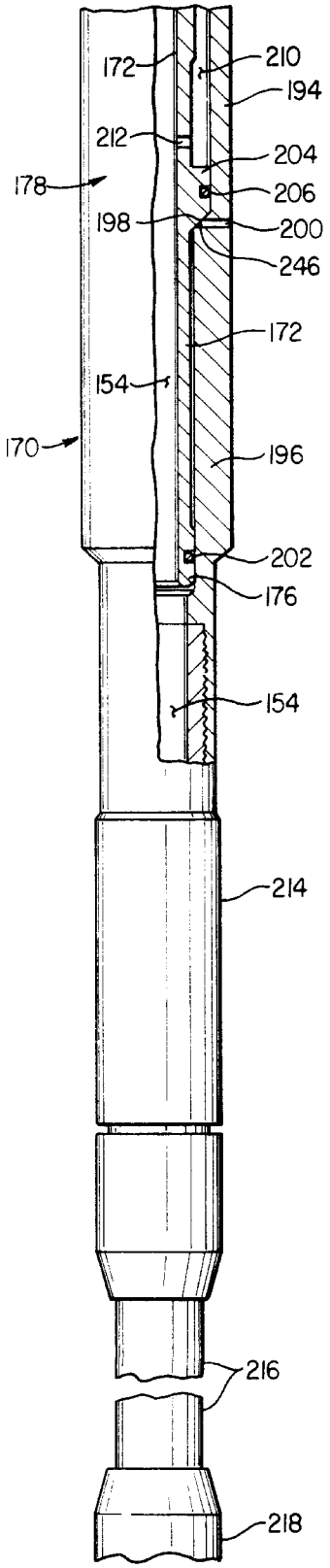

As shown in FIGS. 13C and 13D, the radially thinner section of the lower expansion joint body portion 194 is spaced radially outwardly of the inner mandrel extension member 172 and defines therewith an annular space 210 that axially extends between the lower end portion 192 of the body member 182 and the thickened annular portion 204. For purposes later described, a fluid inlet port 212 is formed in the inner mandrel extension member 172 (see FIG. 13D) and communicates the interior 154 of the inner mandrel 30 with the annular space 210.

Figure 13E:
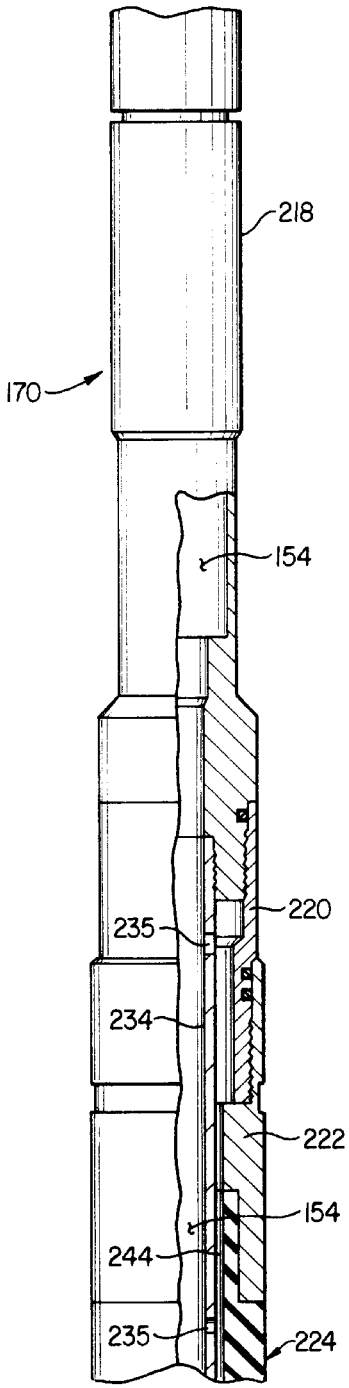
Figure 13F:
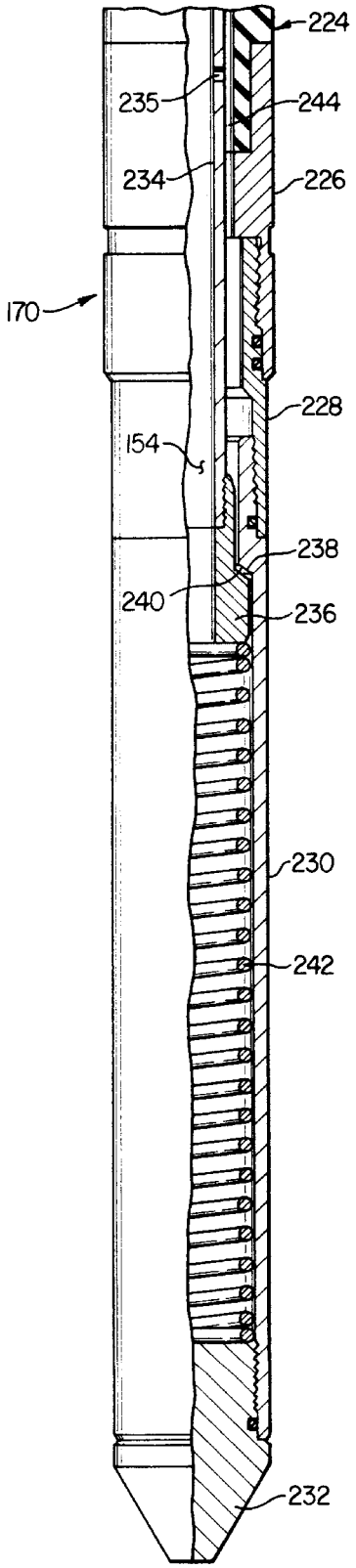

Referring now to FIGS. 13D–13F, the lower end of the expansion joint body portion 196 is threadingly connected to an upper coiled tubing connector 214 in turn secured to the upper end of a length of coiled tubing 216 shown in longitudinally foreshortened form in FIG. 13D. As later described herein, according to a key advantage of the present invention the length of coiled tubing 216 may be any desired length, even several hundred feet long if needed to accommodate the particular straddle packer application. The lower end of the coiled tubing 216 is secured to a lower coiled tubing connector 218 whose bottom end (see FIG. 13E) is threaded into a tubular coupling member 220 which, in turn, is threaded into a tubular upper packer shoe structure 222.

A lower inflatable packer structure 224 (identical in construction to the previously described upper packer 20) is operatively secured between the upper shoe structure 222 and a lower shoe structure 226. The bottom end of the lower shoe structure 226 is threaded onto a tubular coupling member 228 (see FIG. 13F) which, in turn, is threaded onto the upper end of a tubular spring housing member 230. The spring housing member 230 has an open lower end into which a closure plug member 232 is threaded.

An inflation pressure distribution tube 234 (see FIGS. 13E and 13F), having side wall openings 235 therein, is coaxially disposed within the interior of the tool 170 and has an upper end threaded into the lower coiled tubing connector 218, and a lower end threaded into a tubular spring stop member 236. The spring stop member 236 has an annular, upwardly facing exterior shoulder 238 that opposes a corresponding downwardly facing annular interior shoulder 240 formed on an upper end portion of the spring housing member 230. A compression spring member 242 is disposed within the interior of the spring housing member 230 and respectively bears at its upper and lower ends against the bottom end of the spring stop member 236 and the upper end of the end plug 232. As discussed above with reference to spring 68, spring 242 may be left out of the tool 170 assembly if desired. Spring 242 exerts a downwardly directed biasing force, in addition to the biasing force exerted by the weight of spring housing 230 and end plug 232, on the spring housing body 230, and thus on the lower packer shoe 226, to correspondingly exert a longitudinal tension force on the lower packer 224, thereby biasing the lower packer toward its uninflated cylindrical configuration, in a manner similar to the longitudinal tension force exerted on the upper packer 20 by its associated spring member 68 (see FIGS. 13A and 13B).

The interior of the tool structure shown in FIGS. 13D–13F defines a downward continuation of the interior passage 154 within the inner mandrel 30. This interior passage 154 communicates, via the side wall openings 235 in the tube 234, with an annular space 244 disposed between the tube 234 and the inner side of the lower inflatable packer 224.

Figure 12:
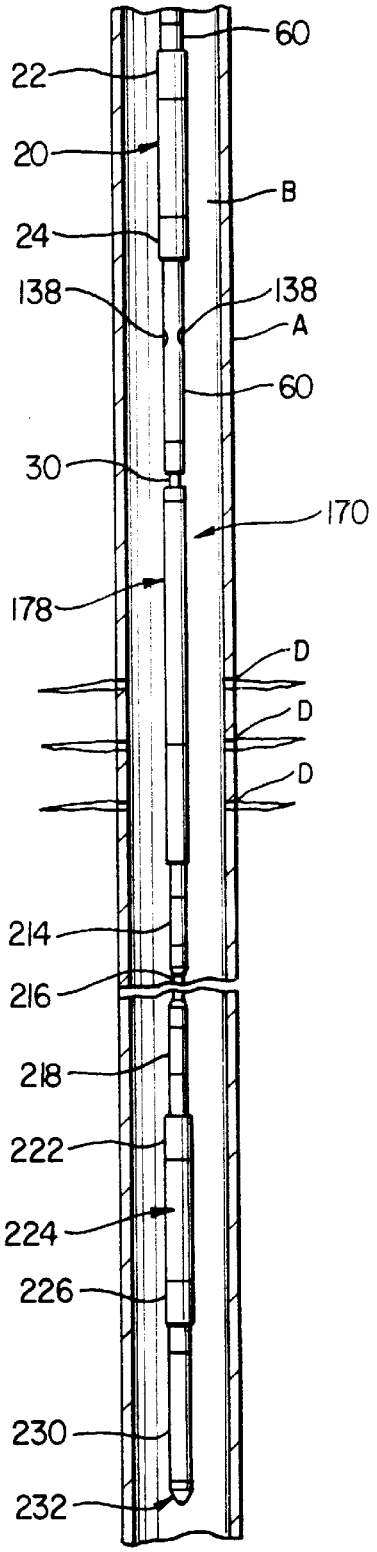
FIGS. 12 and 12A are schematic elevational views of a straddle packer embodiment of the inflatable stimulation tool.
Figure 12A:
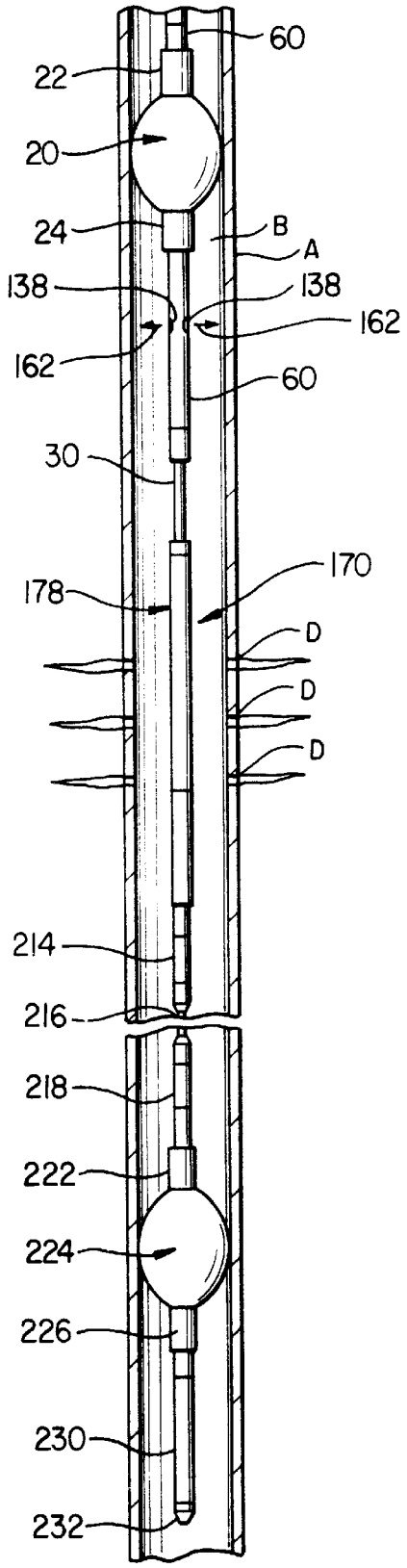

In use, the stimulation tool 170 (with the upper and lower packers 20 and 224 in their uninflated states) is lowered on the coiled tubing M into the casing A as schematically shown in FIG. 12 to position the upper packer 20 above the casing perforations D to be stimulated, and the lower packer 224 below the casing perforations. With the tool 170 lowered into place in this manner, the upper and lower packers 20 and 224 are inflated into sealing engagement with the inner side surface of the casing A (as shown in FIG. 12A) by sequentially flowing pressurized inflation fluid downwardly through the coiled tubing M, through the upper end portion of the tool 170, and through the interior inflation passage of the tool. Referring to FIGS. 13A–13F, this internal inflation passage comprises, from top to bottom along the length of the tool 170, the upper packer inflation annulus 25; the vertically sloped crossover structure bore 156; the axially extending crossover structure bore 152; the interior 154 of the inner mandrel 30; the side wall inlet openings 235 in the tube 234; and the lower packer inflation annulus 244 at the bottom of the tool. Pressure in this internal inflation passage may be limited to a predetermined value, if desired, by using a pressure relief device 400 (see FIG. 17), described hereinbelow.

Figure 14A:
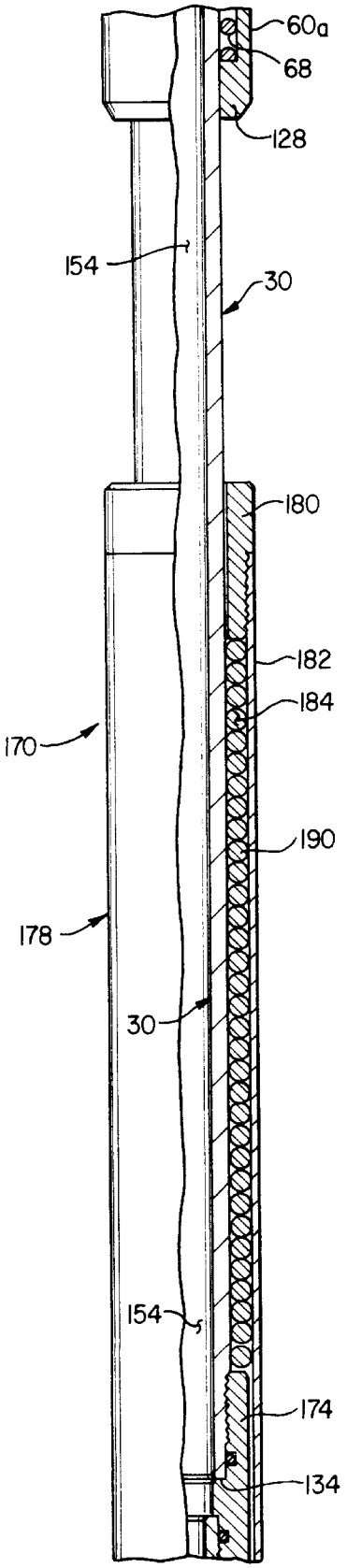
FIGS. 14A and 14B are downwardly successive quarter-sectioned longitudinal portions of the expansion joint section in its extended position.
Figure 14B:
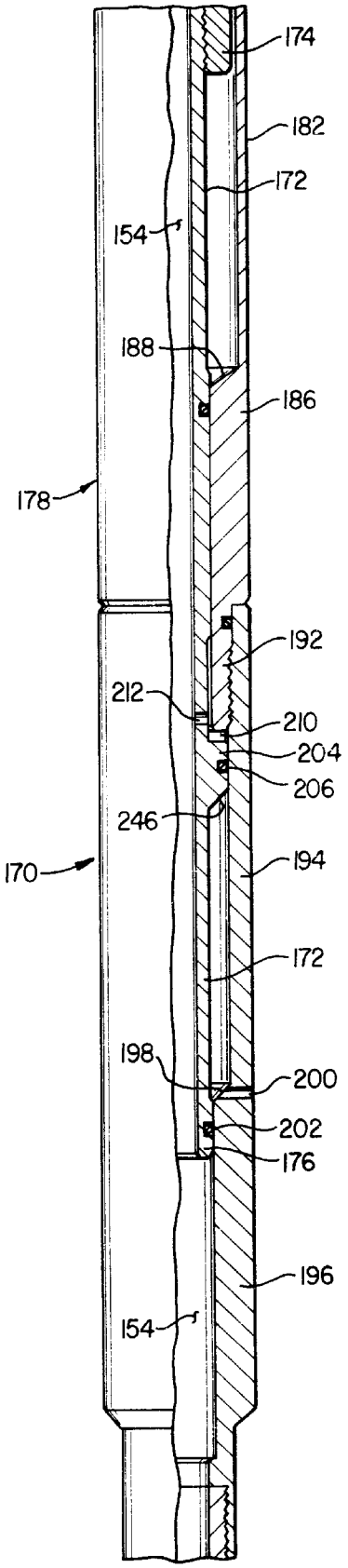

The inflation of the upper and lower packers 20 and 224 seals off the interior of the casing A above and below the casing perforations D, with the radial expansion and longitudinal shortening of the packers 20 and 224 causing an upward shifting of the outer mandrel portion 60*a* (see FIG. 13B) and the spring housing body 230 (see FIG. 13F), thereby compressing the upper and lower spring elements 68 and 242). The axial forces imposed on the tool portion between the packers by their inflation causes the expansion joint structure 178 to axially telescope from its run-in retracted position shown in FIGS. 12 and 13B–13D to its expanded inflation position shown in FIGS. 12A, 14A and 14B.

The expansion joint structure 178 thus serves to compensate for the axial forces exerted on the tool portion between the packers by their inflation-created longitudinal shortening. As may be seen by comparing 13B and 13C to FIG. 14A, this longitudinal shortening of the upper and lower packers 20 and 224 causes the expansion joint body member 182 to move downwardly along the inner mandrel 30 in a manner exposing more of the inner mandrel 30 above the coupling member 180 and compressing the spring member 190.

As will be appreciated, during run-in of the tool 170 the weight of the lower longitudinal tool structure exerted on the spring member 190 exerts an axially compressive force thereon, thus tending to undesirably reduce the maximum available extension stroke of the expansion joint structure 178 when the packer inflation cycle is initiated. According to a feature of the present invention, however, this weight-created expansion joint extension stroke is reduced by a unique pressure balancing of the expansion joint structure which will now be described with reference to FIG. 13D.

During the initial inflation of the upper and lower packers 20 and 224, pressurized inflation fluid in the interior of the inner mandrel extension member 172 is forced into the annular space 210 through the side wall opening 212 in the extension member 172. Due to the fact that the diameter of the O-ring seal member 206, as previously mentioned, is slightly greater than the diameter of the O-ring seal member 202, the net vertical fluid pressure force on the extension member 172 is downwardly directed. This net downward fluid pressure force thus biases the expansion joint structure toward its retracted position shown in FIGS. 13C and 13D and at least partially compensates for the compression of the spring member 190 caused by the tool structure weight borne by the spring.

After the inflation of the upper and lower packers 20 and 224 is completed, pressurized fluid is forced downwardly through the stimulation fluid passage within the tool 170 to force stimulation fluid outwardly through the side wall discharge ports 138, into the interior of the casing A, as indicated by the arrows 162 in FIGS. 12A and 13B. This stimulation fluid passage within the interior of the tool 170 is sealingly separated from the interior inflation fluid passage by the crossover structure 120 and comprises, from top to bottom in FIGS. 13A and 13B, the interior 142 of the inner mandrel structure 30; the crossover structure bores 140 and 158, the radially inset portion 160 of the crossover structure; the crossover structure annulus 150; and the annular space 126.

Due to the routing of the inflation passage through the interior of the tool 170 to each of its upper and lower inflatable packers 20 and 224 made possible by the crossover structure 120, the previous necessity of coupling the upper and lower packers by an external bypass tubing through which inflation fluid is flowed is eliminated. This elimination of such external bypass tubing provides two primary advantages. First, due to the absence of bypass inflation fluid transfer tubing around the exterior of the tool 170, the tool may be lubricated into the well without hindrance by such tubing.

Second, as is well known, the use of external bypass inflation tubing on a straddle packer tool is, as a practical matter, limited to tools in which the packer-to-packer distance is relatively short due to practical limitations on working lubricator length. However, due to the presence in the straddle packer stimulation tool 170 of the entirely internal flow passage communication of the two packers, the distance between the two packers may be very great (i.e., many hundreds or even several thousand feet if desired), with the packers being vertically separated by the appropriate length of coiled tubing 216 as shown in FIGS. 12 and 13D. The assembly 170 may now be run through the lubricator L and blowout preventer seals without hindrance.

After the stimulation process is completed, the packers 20 and 224 are deflated, as previously described in conjunction with the tool 10, and are pulled back to their original generally tubular configurations by the springs 68 and 242. The stimulation tool 170 may then be pulled out of the casing A or repositioned and reset therein as desired.

Figure 15:
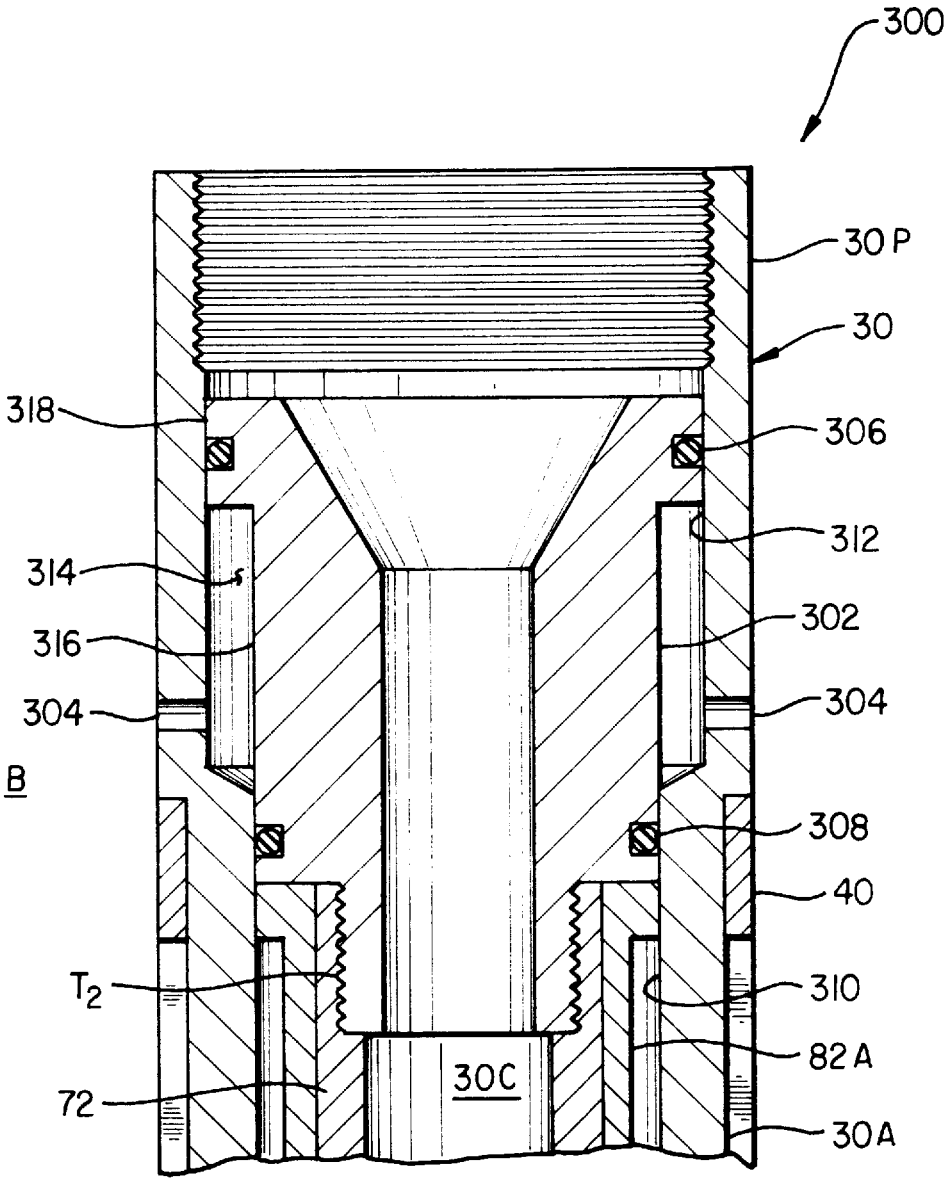
FIG. 15 is an enlarged sectional view of a portion of the tool, illustrating an optional pressure assist device for operation in combination with the velocity valve.

FIG. 15 representatively illustrates an optional pressure assist configuration 300 to assist in the operation of velocity valve mandrel 72. Illustrated in FIG. 15 is a sectional view of an upper portion of inflatable stimulation tool 10, or alternatively, stimulation tool 170, with the pressure assist configuration 300. In an embodiment having the pressure assist configuration 300, inner mandrel 30 is identical to the inner mandrel 30 in any of the previously described embodiments, with the exception of an upper portion 30P of previously described upper seal mandrel 30A (see FIG. 4A).

Upper seal mandrel 30A has an interior bore into which seal 76C of collar lock 76 (see FIG. 4A) is sealingly engaged in previously described embodiments. The upper seal mandrel 30A interior bore is illustrated in FIG. 15 as interior bore 310. A radially enlarged interior bore 312 in upper portion 30P is spaced longitudinally upwardly from interior bore 310.

Pressure assist piston 302 is threadedly secured to velocity valve mandrel 72 with threads T2 in place of the collar lock 76 (see FIG. 4A). Piston 302 has a cylindrical portion 316 having a slightly smaller diameter than that of interior bore 310, and having thereon a circumferential groove containing a seal 308. Another, radially enlarged, portion 318 of piston 302 has a slightly smaller diameter than interior bore 312, and has a circumferential groove thereon containing a seal 306.

Intermediate of seal 306 and seal 308 are pressure assist ports 304 in upper portion 30P, extending transversely therethrough and enabling fluid flow and pressure communication between well bore B and annulus 314, annulus 314 being defined by the annular area between interior bore 312 and cylindrical portion 316.

Operation of the pressure assist configuration 300 is dependent on the difference, if any, between the pressure existing in interior flow passage 30C and the pressure existing in the well bore B adjacent the ports 304. If the pressure in the well bore B adjacent the ports 304 is greater than the pressure in flow passage 30C, a force biasing the piston 302 in an upward direction will result. Such an upward biasing force would be useful in, for example, assisting the return spring 88 in forcing velocity valve mandrel 72 from its third, lowermost position to its first, upper position.

If the pressure in the interior flow passage 30C is greater than the pressure in the well bore B adjacent the ports 304, a force biasing the piston 302 in a downward direction will result. Such a downward biasing force would be useful in, for example, overcoming the upward biasing force of the return spring 88 in situations in which it is not possible to have a relatively high flow rate through nozzle 74 to produce the longitudinally downward velocity driven force component described above. Such a situation can occur when packer element 20 is inflated and tool 10 or 170 is in its stimulation mode wherein the fluids Q are to be pumped into a formation through perforations D. If a relatively high flow rate of fluids Q can be maintained flowing through inner mandrel passage 30C, Velocity valve mandrel 72 will be maintained in its third, lowermost position as described above; but if the formation will not receive the fluids Q through perforations D at a relatively high flow rate, return spring 88 will overcome the longitudinally downward velocity driven force component and force nozzle 74 away from seat 32 and undesirably interrupt the stimulation mode. Pressure assist configuration 300 prevents interruption of the stimulation mode by maintaining a downwardly biased force on velocity valve mandrel 72 to overcome the upwardly biased force of return spring 88.

Figure 16A:
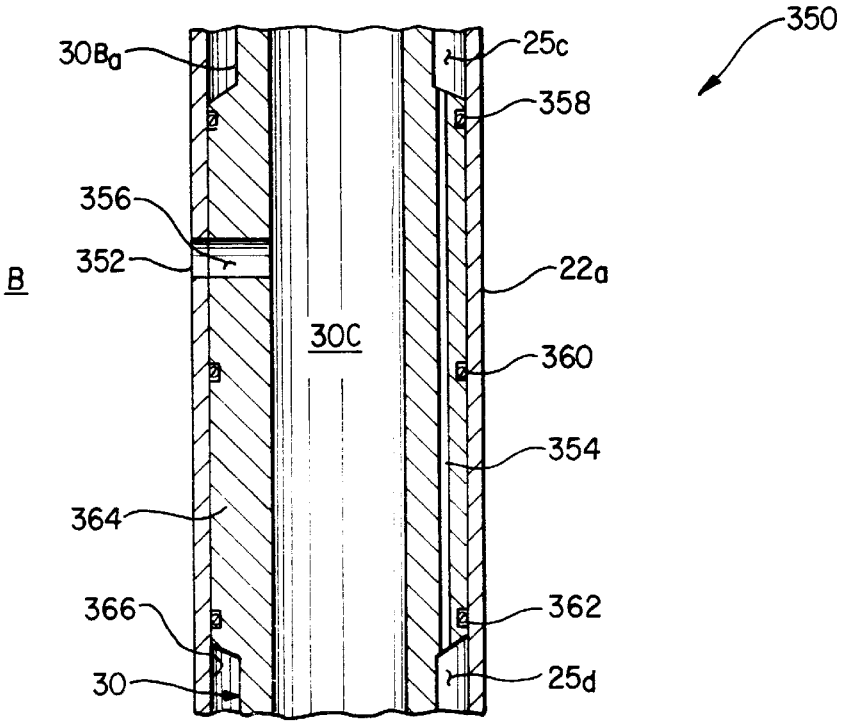
FIGS. 16A and 16B are a sectional views of a portion of the tool, illustrating an optional pressure bleed configuration in successive alternate positions.
Figure 16B:
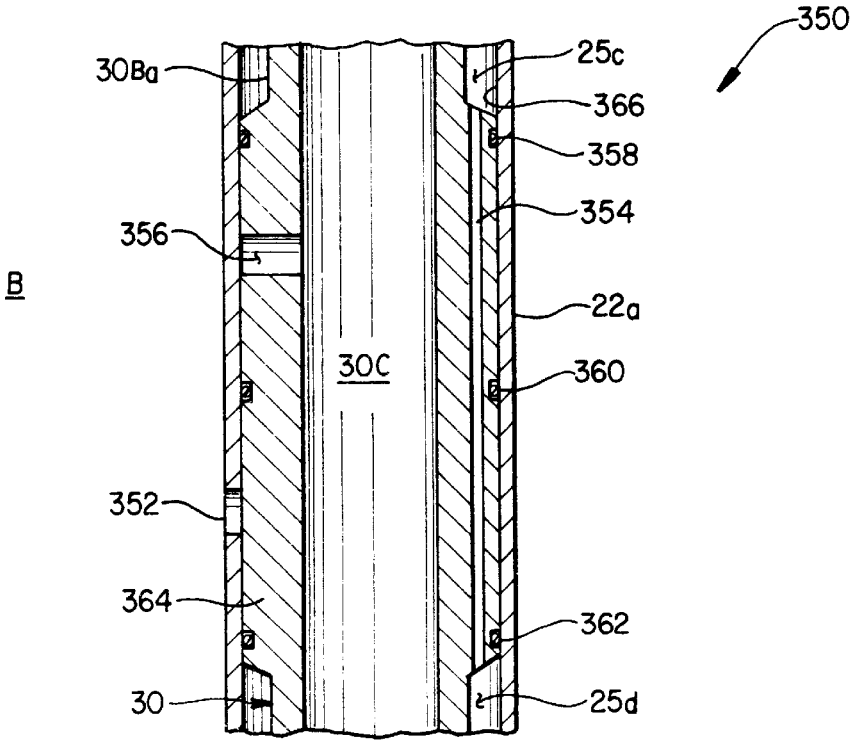

Turning now to FIGS. 16A and 16B, sectional views of an optional pressure bleed structure 350 are illustrated, FIG. 16A illustrating the pressure bleed structure in a first, open position, and FIG. 16B illustrating the pressure bleed structure in a second, closed position.

The optional pressure bleed structure 350 may be placed in any of the previously described embodiments of tool 10 or 170 in the longitudinal area adjacent the upper end shoe 22 (see FIGS. 4A & 4B). When incorporated into a previously described embodiment, the structure 350 illustrated in FIGS. 16A and 16B is inserted into tool 10 or 170 at the longitudinal juncture between FIGS. 4A and 4B, such that the lower inner mandrel 30B*a* illustrated in FIGS. 16A and 16B is a portion of the lower inner mandrel 30B intermediate FIGS. 4A and 4B, and the upper end shoe 22*a* illustrated in FIGS. 16A and 16B is a portion of the upper end shoe 22 intermediate FIGS. 4A and 4B.

As previously described, inner mandrel 30 has positions relative to upper outer mandrel 40: a first, lower position (see FIG. 8 illustrating tool 10 in a previously described inflation mode) and a second, upper position (see FIG. 9, illustrating tool 10 in a previously described stimulation mode). The position of mandrel portion 30B*a* with respect to upper end shoe portion 22*a*, in the first, open position of the pressure bleed structure 350 illustrated in FIG. 16A, corresponds to the first, lower position of mandrel 30 with respect to mandrel 40. Likewise, the second, closed position of the pressure bleed structure 350 illustrated in FIG. 16B, corresponds to the second, upper position of mandrel 30 relative to mandrel 40.

Upper end shoe portion 22*a* has a smooth interior surface 366, and pressure bleed port 352 providing fluid and pressure communication between the well bore B and the interior of upper end shoe portion 22*a*. Lower inner mandrel portion 30B*a* has a radially enlarged portion 364 slightly smaller in diameter than the interior surface 366. On the radially enlarged portion 364 are longitudinally spaced circumferential grooves containing, in sequential order from top to bottom, seals 358, 360, and 362, said seals slidably and sealingly engaging interior surface 366.

The radially enlarged portion 364 divides annulus 25 (see FIG. 4B) into two portions, 25*c* and 25*d*, portion 25*c* being longitudinally above the radially enlarged portion 364, and portion 25*d* being longitudinally below the radially enlarged portion 364. Extending longitudinally through the radially enlarged portion 364 of mandrel portion 30B*a*, port 354 provides fluid and pressure communication between annulus portion 25*c* and annulus portion 25*d*.

Port 356 extends radially through the radially enlarged portion 364 intermediate seal 358 and seal 360. When in its first, open position, as representatively illustrated in FIG. 16A, port 356 is longitudinally adjacent port 352 so that fluid and pressure communication is achieved between the well bore B and inner mandrel flow passage 30C. When in its second, closed position, as representatively illustrated in FIG. 16B, port 356 is longitudinally displaced relative to port 352, and port 352 is intermediate seals 360 and 362, thus allowing no fluid or pressure communication between the well bore B and inner mandrel flow passage 30C through port 356.

Such a pressure bleed structure 350 may be desired when tool 10 or 170 is being used in a situation in which fluids Q cannot be pumped into the formation through perforations D at a relatively high flow rate, making packer 20 inflation difficult. The reason packer 20 inflation is difficult in these situations is that some of the fluid being pumped through the tool 10 or 170 to inflate packer 20 is allowed to flow through hole 74B in discharge nozzle 74 (see FIG. 8, illustrating tool 10 in a packer inflation mode as previously described). From there the fluid is in communication with the well bore B longitudinally below packer 20 and can act to pressurize the well bore B below packer 20 before full inflation of packer 20 has been accomplished. If this happens, well bore B below packer 20 will be at a higher pressure relative to well bore B above packer 20, and packer 20, not being fully inflated and secured to the interior surface of casing A or production tubing F, will be pushed upward by the upwardly biasing force resulting from the pressure difference acting on the packer 20. The same situation may occur with tool 170.

Pressure bleed structure 350 prevents the above-described occurrence by establishing fluid and pressure communication between inner mandrel flow passage 30C and the well bore B above packer 20 when mandrel 30 is in its first, lower position relative to mandrel 40 (see FIG. 8), corresponding to the first, open position of pressure bleed structure 350 as illustrated in FIG. 16A. When packer 20 is fully inflated and tool 10 or 170 is in its stimulation mode (see FIG. 9) and mandrel 30 is in its second, upper position relative to mandrel 40, pressure bleed structure 350 is correspondingly in its second, closed position as illustrated in FIG. 16B, allowing well bore B below packer 20 to be pressurized by fluids Q, without pressurizing or pumping fluid into well bore B above packer 20.

Figure 17:
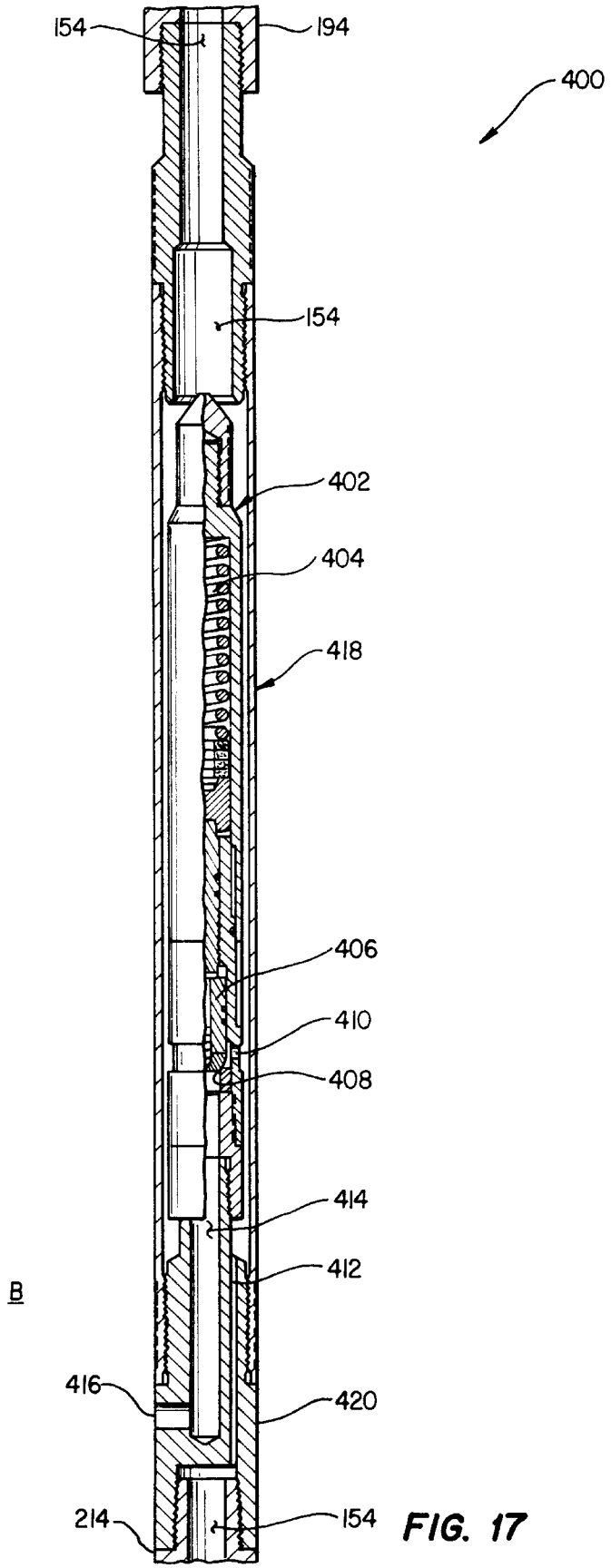
FIG. 17 is a sectional view of a portion of the tool, illustrating an optional pressure relief device.

Representatively illustrated in FIG. 17 is a pressure relief device 400 for use with any of the previously described embodiments. Pressure relief device 400 may be used with tool 10 or 170 to limit the maximum pressure present in the interior of packer 20. Device 400 accomplishes this objective by dumping any excess pressure into well bore B.

Device 400 is a pressure relief device specially adapted to dump excess pressure to the well bore B. Device 400 is representatively illustrated as being installed in the stimulation tool string between the lower tubular expansion joint body section 194 and the upper coiled tubing connector 214 (see FIG. 13D). The interior of device 400 is in fluid and pressure communication with, and forms a part of, the interior 154 of the section of inner mandrel 30 below crossover structure 120.

Communication of fluid and pressure in interior 154 between section 194 and connector 214 is not impeded in any way when device 400 is installed therebetween. Fluid and pressure are able to flow from interior 154 in section 194, through the annulus between the interior of housing 418 and the exterior of pressure relief section 402, and through longitudinally extending port 412 in lower sub 420, thence to interior 154 in connector 214.

Pressure relief section 402 of device 400 acts to displace fluid in interior 154 when a predetermined pressure is exceeded. Pressure in interior 154, acting on piston 406 through port 410, exerts a longitudinally upwardly biasing force on the piston 406. Spring 404 is compressed so that it exerts a predetermined longitudinally downwardly biasing force on the piston 406. When the downwardly biasing force exceeds the upwardly biasing force, the piston 406 is sealingly pressed against seat 408. As thus far described, the structure and operation of pressure relief section 402 is well known in the art.

When, however, the upwardly biasing force exceeds the downwardly biasing force, as, for example, when the pressure existing in interior 154 exceeds a predetermined pressure, piston 406 is displaced upwardly away from seat 408, allowing fluid in interior 154 to flow through seat 408, through longitudinally extending hole 414 in lower sub 420, and thence through intersecting and radially extending port 416 in lower sub 420 to the well bore B. This displacement of fluid from interior 154 to the well bore B when a predetermined pressure is exceeded, acts to reduce the pressure existing in interior 154, thus preventing overpressurization of packer 20.

The foregoing detailed description is to be clearly understood as being given by way of illustration and example only, the spirit and scope of the present invention being limited solely by the appended claims.

What is claimed is:

1. Well packer apparatus comprising:

a tubular outer body structure having, along its length, an annular gap therein;

a tubular inflatable packer member operatively supported in and closing said gap;

a tubular inner body structure coaxially disposed within said outer body structure and defining therewith a generally annular packer inflation passage for receiving a pressurized fluid operative to inflate said packer member, an axial portion of said inflation passage being radially outwardly bounded by said packer member; and a perforated inflation pressure distribution tube member coaxially disposed within said annular packer inflation passage and axially dividing a portion thereof into a first subannulus disposed between said inner body structure and said pressure distribution tube member, and a second subannulus disposed between said pressure distribution tube member and said outer body structure.

2. The well packer apparatus of claim 1 wherein:

said inflation passage has an upper inlet end portion for receiving pressurized fluid from a source thereof, and a lower end portion, said well packer apparatus further comprises interior stop wall portions extending across said upper and lower end portions of said inflation passage, and said inflation distribution tube member is captively retained in said inflation passage for axial movement relative to said inner body structure between said interior stop wall portions.

3. The well packer apparatus of claim 1 further comprising:

valve means in said tubular outer body structure, said valve means having a flow passage therein, for regulating flow of said pressurized fluid from said valve means flow passage to said annular packer inflation passage;

a tubular conduit generally coaxially disposed around said tubular outer body structure and defining an annulus between the interior surface of said conduit and the exterior surface of said tubular outer body structure; and pressure assist means in said tubular outer body structure, for biasing said valve means to permit flow of said pressurized fluid from said valve means flow passage to said annular packer inflation passage when pressure in said valve means flow passage exceeds pressure in said annulus.

4. The well packer apparatus of claim 1 wherein:

said tubular outer body structure has an exterior side wall, and said well packer apparatus further comprises a stimulation fluid bleed opening formed in said exterior side wall and means for directing said pressurized fluid to said stimulation fluid bleed opening.

5. The well packer apparatus of claim 1 wherein:

said tubular outer body structure has an exterior side wall, and said well packer apparatus further comprises an inflation fluid discharge opening formed in said exterior side wall and pressure relief means operatively communicating with said annular packer inflation passage, for forcing said pressurized fluid outwardly through said inflation fluid discharge opening when the pressure of said pressurized fluid in said annular packer inflation passage exceeds a predetermined pressure.

6. A well stimulation tool lowerable into a well bore on conduit means through which a pressurized fluid may be supplied to said tool, said tool comprising:

an elongated hollow tubular body having an open upper end to which a lower end of the conduit means may be connected, and an exterior side wall extending along the length of said body;

an annular inflatable packer member coaxially carried on said exterior side wall;

a stimulation fluid discharge opening formed in said exterior side wall;

an inflation fluid flow passage extending interiorly through said body and operatively communicating with said inflatable packer member;

a stimulation fluid flow passage extending interiorly through said body and communicating with said stimulation fluid discharge opening;

a crossover structure disposed within said tubular body and operative to sealingly separate said inflation fluid and stimulation fluid passages from one another, portions of each of said inflation fluid and stimulation fluid flow passages extending through said crossover structure; and fluid flow path control means operable to route the pressurized fluid received through said open upper end of said body through a selectively variable one of said inflation fluid and stimulation fluid passages to thereby selectively inflate said packer member using the pressurized fluid or force the pressurized fluid outwardly through said stimulation fluid discharge opening.

7. The well stimulation tool of claim 6 wherein:

said body has an open lower end, said tool further comprises a removable plug member secured to and closing off said open lower end, and said stimulation fluid discharge opening is positioned between said packer member and said plug member.

8. The well stimulation tool of claim 6 wherein:

said inflation fluid flow passage has an annular portion radially outwardly bounded by said packer member, and said tool further comprises a perforated inflation pressure distribution tube coaxially disposed in said annular flow passage and dividing it into a first subannulus disposed within said distribution tube and a second subannulus disposed between said distribution tube and said packer member.

9. The well stimulation tool of claim 8 wherein:

said annular portion of said inflation fluid flow passage has axially spaced stop wall structures disposed therein, and said distribution tube is captively retained within said annular portion of said inflation fluid flow passage for axial movement therein between said axially spaced stop wall structures.

10. The well stimulation tool of claim 6 wherein said fluid flow path control means is biased to selectively inflate said packer member using the pressurized fluid or force the pressurized fluid outwardly through said stimulation fluid discharge opening by a difference between a pressure of the pressurized fluid and a pressure in the well bore external to said body.

11. The well stimulation tool of claim 6 further comprising:

a stimulation fluid bleed opening formed in said exterior side wall so that said packer member is intermediate said stimulation fluid bleed opening and said stimulation fluid discharge opening, said stimulation fluid bleed opening being communicated with said stimulation fluid flow passage when said inflation fluid flow passage is selected by said fluid flow path control means.

12. The well stimulation tool of claim 6 further comprising:

an inflation fluid discharge opening formed in said exterior side wall; and pressure relief means operatively communicating with said inflation fluid flow passage, for forcing the pressurized fluid outwardly through said inflation fluid discharge opening when the pressurized fluid pressure in said inflation fluid flow passage exceeds a predetermined pressure.

13. A well stimulation tool lowerable into a well bore on conduit means through which a pressurized fluid may be supplied to said tool, said well stimulation tool comprising:

an elongated hollow tubular body having an open upper end to which a lower end of the conduit means may be connected, and an exterior side wall extending along the length of said body;

an annular inflatable first packer structure coaxially carried on an upper longitudinal portion of said exterior side wall;

an annular inflatable second packer structure coaxially carried on a lower longitudinal portion of said exterior side wall;

a stimulation fluid discharge opening formed in said exterior side wall between said first and second packer structures;

a first flow passage extending interiorly through said body, said first flow passage being sealingly isolated from said stimulation fluid discharge opening and operatively communicated with said first and second packer structures;

a second flow passage extending interiorly through said body, said second flow passage being communicated with said stimulation fluid discharge opening and isolated from said first and second packer structures; and fluid flow path control means operable to route pressurized fluid received through said open upper end of said body through a selectively variable one of said first and second flow passages to thereby selectively inflate said first and second packer structures using the pressurized fluid or force the pressurized fluid outwardly through said stimulation fluid discharge opening.

14. The well stimulation tool of claim 13 further comprising:

an axially telescopable expansion joint structure defining a portion of said body disposed between said first and second packer structures and being movable between retracted and extended positions.

15. The well stimulation tool of claim 14 further comprising:

mechanical spring means for resiliently biasing said expansion joint structure toward said retracted position thereof.

16. The well stimulation tool of claim 15 further comprising:

fluid pressure force exerting means, responsive to the presence of pressurized fluid within said first flow passage, for exerting a fluid pressure force on said expansion joint structure in a manner further biasing said expansion joint structure toward said retracted position thereof.

17. The well stimulation tool of claim 16 wherein:

said expansion joint structure includes an inner tubular portion slidably and coaxially disposed within an outer tubular portion and forming therebetween an annular pressure biasing space, and said fluid pressure force exerting means include a side wall opening formed in said inner tubular portion and communicating the interior thereof with said annular pressure biasing space, and axially opposing wall means carried on said inner and outer tubular portions and operative to bias said inner tubular portion axially outwardly from said outer tubular portion in response to the entrance into said annular pressure biasing space, through said side wall opening, of pressurized fluid.

18. The well stimulation tool of claim 13 wherein:

said body has an inner tubular portion spaced radially inwardly of said first packer structure and forming therewith an annular portion of said first flow passage, and said well stimulation tool further comprises a perforated inflation pressure distribution tube member coaxially disposed within said annular first flow passage portion and axially dividing it into a first subannulus disposed between said inner tubular portion and said distribution tube member, and a second subannulus disposed between said distribution tube member and said first packer structure.

19. The well stimulation tool of claim 18 wherein:

said annular first flow passage has an upper inlet end portion for receiving pressurized fluid from a source thereof, and a lower end portion, said well stimulation tool further comprises interior stop wall portions extending across said upper and lower end portions of said annular first flow passage, and said distribution tube member is captively retained in said annular first flow passage for axial movement relative to said inner tubular portion between said interior stop wall portions.

20. The well stimulation tool of claim 13 wherein said fluid flow path control means include:

a crossover structure disposed within said body between said first and second packer structures, portions of said first and second flow passages extending through said crossover structure.

21. The well stimulation tool of claim 20 wherein:

said first flow passage includes, from top to bottom along the length of said tool, a radially inner interior portion of said body communicating with said first packer structure, a first interior portion of said crossover structure, a radially inner interior portion of said body, and a radially outer interior portion of said body communicating with said second packer structure, and said second flow passage includes, from top to bottom along the length of said tool, a radially inner interior portion of said body, a second interior portion of said crossover structure, and a radially outer interior portion of said body communicating with said stimulation fluid discharge opening.

22. The well stimulation tool of claim 13 wherein:

said body has an upper end portion on which said first packer structure and said stimulation fluid discharge opening are disposed, a lower end portion on which said second packer structure is disposed, and a longitudinally intermediate portion defined by a length of coiled tubing connected at opposite ends thereof to said upper and lower end portions of said body.

23. The well stimulation tool of claim 13 further comprising:

spring means for biasing said first and second packer structures toward uninflated configurations thereof.

24. The well stimulation tool of claim 13 wherein said fluid flow path control means is biased to selectively inflate said first and second packer structures using the pressurized fluid or force the pressurized fluid outwardly through said stimulation fluid discharge opening by a difference between a pressure of the pressurized fluid and a pressure in the well bore external to said body.

25. The well stimulation tool of claim 13 further comprising:

a stimulation fluid bleed opening formed in said exterior side wall so that said first packer structure is intermediate said stimulation fluid bleed opening and said stimulation fluid discharge opening, said stimulation fluid bleed opening being communicated with said second flow passage when said first flow passage is selected by said fluid flow path control means.

26. The well stimulation tool of claim 13 further comprising:

an inflation fluid discharge opening formed in said exterior side wall; and pressure relief means operatively communicating with said inflation fluid flow passage, for forcing the pressurized fluid outwardly through said inflation fluid discharge opening when the pressurized fluid pressure in said inflation fluid flow passage exceeds a predetermined pressure.

27. A well stimulation tool lowerable into a well bore on conduit means through which a pressurized fluid may be supplied to said tool, said well stimulation tool comprising:

an elongated hollow tubular body having an upper end portion to which a lower end of the conduit means may be connected, a lower end portion, and an intermediate portion extending between said upper and lower end portions;

an annular inflatable first packer structure coaxially carried on said upper end portion of said tubular body;

an annular inflatable second packer structure coaxially carried on said lower end portion of said tubular body;

a stimulation fluid discharge opening formed in said tubular body between said first and second packer structures;

a first flow passage extending interiorly through said body, said first flow passage being sealingly isolated from said stimulation fluid discharge opening and operatively communicated with said first and second packer structures;

a second flow passage extending interiorly through said body, said second flow passage being communicated with said stimulation fluid discharge opening and isolated from said first and second packer structures;

fluid flow path control means operable to route pressurized fluid received through said open upper end of said body through a selectively variable one of said first and second flow passages to thereby selectively inflate said first and second packer structures using the pressurized fluid or force the pressurized fluid outwardly through said stimulation fluid discharge opening;

telescopable expansion joint means operably interposed in said intermediate portion of said tubular body and being axially movable between expanded and retracted positions; and fluid pressure force exerting means for utilizing pressurized fluid in said first flow passage to bias said expansion joint means toward said retracted position thereof.

28. The well stimulation tool of claim 27 further comprising:

spring means for further biasing said expansion joint means toward said retracted position thereof.

29. The well stimulation tool of claim 27 wherein:

said fluid flow path control means includes a crossover member disposed in said tubular body between said first and second packer structures, with portions of each of said first and second flow passages passing through said crossover member.

30. The well stimulation tool of claim 27 wherein said fluid flow path control means is biased to selectively inflate said first and second packer structures using the pressurized fluid or force the pressurized fluid outwardly through said stimulation fluid discharge opening by a difference between a pressure of the pressurized fluid and a pressure in the well bore external to said body.

31. The well stimulation tool of claim 27 further comprising:

a stimulation fluid bleed opening formed in said exterior side wall so that said first packer structure is intermediate said stimulation fluid bleed opening and said stimulation fluid discharge opening, said stimulation fluid bleed opening being communicated with said second flow passage when said first flow passage is selected by said fluid flow path control means.

32. The well stimulation tool of claim 27 further comprising:

an inflation fluid discharge opening formed in said exterior side wall; and pressure relief means operatively communicating with said first flow passage, for forcing the pressurized fluid outwardly through said inflation fluid discharge opening when the pressurized fluid pressure in said first flow passage exceeds a predetermined pressure.

* * * * *